US006902857B2

(12) United States Patent
Yagi et al.

(10) Patent No.: US 6,902,857 B2
(45) Date of Patent: Jun. 7, 2005

(54) METHOD FOR FORMING ELECTROPHOTOGRAPHIC IMAGE AND ELECTROGRAPHIC DEVICE

(75) Inventors: Shinichiro Yagi, Shizuoka (JP); Naohito Shimota, Shizuoka (JP); Tatsuya Niimi, Shizuoka (JP); Satoshi Mochizuki, Shizuoka (JP); Hiroaki Matsuda, Shizuoka (JP); Tomomi Tamura, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 130 days.

(21) Appl. No.: 10/176,578

(22) Filed: Jun. 24, 2002

(65) Prior Publication Data

US 2003/0138718 A1 Jul. 24, 2003

(30) Foreign Application Priority Data

Jun. 25, 2001 (JP) ..... 2001-191890
May 9, 2002 (JP) ..... 2002-134551

(51) Int. Cl.[7] ..... G03G 13/08

(52) U.S. Cl. ..... 430/125; 430/66; 430/111.4; 399/159

(58) Field of Search ..... 430/125, 111.4, 430/110.3, 66, 58.05; 399/159

(56) References Cited

U.S. PATENT DOCUMENTS 5,028,502 A 7/1991 Yuh et al.
5,100,453 A 3/1992 Richards
5,708,941 A * 1/1998 Koga et al. ..... 399/272
5,789,128 A 8/1998 Adachi et al.
5,834,145 A 11/1998 Yoshinaga et al.
5,846,680 A 12/1998 Adachi et al.
5,910,561 A 6/1999 Adachi et al.
5,928,828 A 7/1999 Suzuki
5,942,363 A 8/1999 Tanaka et al.
5,999,773 A 12/1999 Yasutomi et al.
6,026,262 A 2/2000 Kinoshita et al.
6,030,736 A 2/2000 Ikegami et al.
6,069,224 A 5/2000 Adachi et al.
6,136,483 A 10/2000 Suzuki et al.
6,191,249 B1 2/2001 Tanaka et al.
6,249,304 B1 6/2001 Sawayama et al.
6,322,940 B1 11/2001 Nishigaki et al.
6,326,112 B1 12/2001 Tamura et al.
6,360,068 B1 3/2002 Kinoshita et al.
6,363,229 B1 3/2002 Shiraishi et al.
6,366,751 B1 4/2002 Shakuto et al.
6,372,398 B1 * 4/2002 Yamada et al. ..... 430/66
6,395,443 B2 5/2002 Kuroda et al.
6,403,275 B1 6/2002 Kuramoto et al.
6,406,826 B1 6/2002 Suzuki et al.
6,432,589 B1 8/2002 Uchinokura et al.
6,432,596 B2 8/2002 Ikuno et al.
6,444,387 B2 9/2002 Ri et al.
6,468,706 B2 10/2002 Matsuda et al.
6,492,079 B2 12/2002 Shimada et al.
6,521,387 B2 * 2/2003 Kawasaki ..... 430/59.5

* cited by examiner

*Primary Examiner*—John L. Goodrow
(74) *Attorney, Agent, or Firm*—Oblon, Spivak, McClelland, Maier & Neustadt, P.C.

(57) ABSTRACT

A method for forming an electrophotographic image and a device for forming an image on a transfer material by the steps for charging, exposing, developing and transferring, and recovering the toner remained untransferred in the step for cleaning by recovering, wherein the toner used in the step for developing has a total surface area ratio Z of additive, which is calculated by $Z=(Ht \cdot Wt)/(H \cdot W)$, satisfies $0.5 \leqq Z \leqq 1.5$, the electrophotographic photoconductor used comprises at least a photosensitive layer and a filler-containing protective layer provided on a conductive support in that order, and the angle of repose of the toner to the protective layer surface of the electrophotographic photoconductor is 30° or less.

27 Claims, 6 Drawing Sheets

METHOD FOR FORMING ELECTROPHOTOGRAPHIC IMAGE AND ELECTROGRAPHIC DEVICE

BACKGROUND OF THE INVENTION

1. Field of the Invention

The present invention relates to a method for forming an electrophotographic image and electrophotographic device and, more particularly, to a method for forming an electrophotographic image and electrophotographic device using a toner having a total surface area ratio of additive in toner of 0.5–1.5 and an angle of repose of toner to the protective layer of a electrophotographic photoconductor of 30° or less.

2. Description of the Related Art

Conventionally, there are various electrophotographic methods known, which generally relates to a method of forming an electrostatic latent image on an image carrier (photoconductor) by various means utilizing a photoconductive material, developing the latent image with toner to form a visible image, transferring the toner image to a transfer material such as paper if necessary, and fixing the toner image on the transfer material by applying heat, pressure or the like to create a printed article.

For known methods for visualizing the electrical latent image, cascade development method, magnetic brush development method, pressure development method and the like may be mentioned. Further, there is also known a method in which magnetic toner released by a rotating sleeve having magnetic pole in the center is fed into an electric field created in between a photoconductor and a sleeve.

A one-component developing method allows reduction in size and weight of a developing device itself because it does not require carrier particles such as glass bead, iron powder, or the like as required in a two-component method. In order to maintain the toner concentration in a carrier constant, the two-component development method requires a device for detecting the toner concentration and supplying necessary amount of the toner, hence the development device is increased both in size and weight. On the other hand, one-component developing method is preferable in terms of reduction in the size and weight of the developing device because a device for detecting is not necessary.

For printer devices, LED and LBP printers are becoming mainstream technology in the market accompanying a technical trend to attain higher resolution, namely 400, 600 dpi in the past to 800, 1200 dpi at present. Concurrent with this trend, demand for higher definition in the development method is also pursued. Further, in the field of copying machines, digitalization prevails to cope with demand for improved functionality. Since the digitalization primarily intends formation of an electrostatic image with laser, aiming at higher resolution is becoming the focus of advancement of the technical trend. Accordingly, the developing method also calls for higher resolution/higher definition in the field of copying machines similarly to printers. Therefore, particle diameter of a toner is increasingly becoming smaller, and for instance, toners having small particle diameter existing in specific particle diameter distributions are proposed in Japanese Patent Application Laid-Open Nos. 3-181952, 4-162048, and the like.

The toner image formed on a photoconductor during developing process is transferred to a transfer material in the transfer process, and the residual toner untransferred on the photoconductor is cleaned in the cleaning process and stored in a waste toner vessel. In the cleaning process, generally, blade cleaning, fur brush cleaning, roller cleaning and the like are used. From the viewpoint of device configuration, such cleaning device is an inevitable equipment, and thus leads to an enlargement of the device as a whole, causing difficulty in realizing a device compact in size. Further, from the viewpoint of environmental protection, a system which minimizes the toner waste and promoting effective use of toner is desired, along with toner having high transfer ability.

According to the reduction in the size (or diameter) of toner particle, the adhesive force of the toner particle to a latent image carrier (mirror image force, van der Waals force, etc.) tends to increase, compared to the Coulomb's force applied to the toner particle at the time of transfer, consequently causing amount of the toners untransferred to increase.

In a roller charging method, the physical and chemical effect of the electrostatic latent image carrier surface by a discharge generated between an charge roller and the electrostatic latent image carrier is high, compared with that in a corona electric charging method, and a wear caused by the deterioration of the surface of photoconductor tends to occur, particularly, when an organic photoconductor/blade cleaning are used in combination, thus leaving a problem of shortened life (the combination of direct charging/organic photoconductor/one-component magnetic development method/contact transfer/blade cleaning is the mainstream technology in copying machines, printers, facsimiles and the like in the field demanding low price, small size and light weight, because reduction in cost, size and weight of an image forming device is relatively easy).

A study on adding filler to the protective layer of the electrophotographic photoconductor was carried out in an attempt to prevent the wear of the electrophotographic photoconductor (improvement in printing resistance). A study on protective layer used as surface layer of the photoconductor initially directed on organic photoconductors, including, for example, those disclosed in Japanese Patent Publication Nos. 2-3171, 2-7058, 3-43618, and the like. When the protective layer is provided on the surface of an inorganic photoconductor, fillers having relatively low resistance were suitably used as the protective layer (Japanese Patent Application Laid-Open Nos. 63-254462 and 63-254463). Therefore, electricity was charged more often in the protective layer as a whole or in the interface of protective layer/inorganic photosensitive layer rather than on the surface of the electrophotographic photoconductor. When the latent image was formed not on the surface of electrophotographic photoconductor but on the inner portion of the protective layer (including the interface with the inorganic photosensitive layer), an advantage was confirmed in that the influence of the shapes (flaw, etc.) which appear on the surface of the electrophotographic photoconductor was minimized. However, in order to render the surface layer to act as the protective layer, it is necessary to add a large amount of a conductive metal oxide as the filler to be added to the surface layer. In this case, even if the transparency of the surface layer is ensured by choosing an appropriate material, the bulk or surface resistance of the surface layer deteriorates, often causing image blurring in repeated use. To solve such disadvantages, Japanese Patent Publication No. 2-7057 and Patent No. 2675035 discloses a method to change the conductive metal oxide concentration in the surface layer in the depth direction of the coating surface, whereby the image blurring and flowing are suppressed.

In order to suppress image blurring, a method for mounting a drum heater to heat the electrophotographic photoconductor during the process is disclosed. However, in order to mount the drum heater to prevent image blurring by heating the electrophotographic photoconductor, the electrophotographic photoconductor needs to have large diameter, and therefore such method could not be applied to electrophotographic photoconductors having small diameters which are the focus of mainstream technology accompanying miniaturization of electrophotographic devices. Moreover, it is difficult to improve durability of the electrophotographic photoconductors having minor diameters. Further, the size of the device is inevitably increased by mounting the drum heater, thus causing increase in electric power consumption, and time consuming start up and the like, leaving various problems unsolved.

On the other hand, a surface layer (protective layer) using a filler having low resistance was laminated on a electrophotographic photoconductor using an organic charge generating material and charge transporting material (referred to as OPC) using the technique above-mentioned, and tested in repeated uses. As a result, image flowing was observed assumedly due to the poor matching property with OPC. Substantially the same result was observed in a method creating a concentration distribution in the surface layer of the conductive metal oxide, the method which was effective for inorganic photoconductors. The reason for the cause of image flow is not clear. In the recent electrophotographic process using organic photoconductors, a digital signal is used in a manner to be dotted-in when writing on the photoconductor, the manner which is very different from the manner applied for inorganic photoconductors. From the viewpoint of machine configuration, the level of resolution required has changed dramatically, thus rendering such phenomenon (defects) obvious.

Under such circumstances, it is essential to use a non-conductive and highly resistant filler in the surface layer of the organic photoconductor. However, use of highly resistant filler often causes a problem of increased residual potential. The frequently observed increase in residual potential leads to a high bright part potential within the electrophotographic device, causing reduction in image density or tones. Although it is necessary to raise the dark part potential for compensation, the increase in dark part potential brings up the field intensity, which not only causes an image defect such as toner deposition on the background of images, and the like but also leads to reduced life of the photoconductor. From such a viewpoint, a combination of two kinds of fillers was examined, but the problem in which the presence of a large amount of low resistant filler on the surface of photoconductor causes image blur in repeated use cannot be prevented, thus leaving a basic problem unsolved.

To suppress presence of residual potential in the related art, use of photoconductive layer as the protective layer is disclosed (Japanese Patent Publication Nos. 44-834, 43-16198, and 49-10258). However, since the amount of light reaching the photosensitive layer is reduced due to absorption of light by the protective layer, the problem of deterioration in sensitivity of the photoconductor arises, while exhibiting less effect.

It is also disclosed to make the protective layer substantially transparent to suppress accumulation of residual potential by determining average particle diameter of a metal or metal oxide contained in the filler to be 0.3 $\mu$m or less (Japanese Patent Application Laid-Open No. 57-30846). In this method, an effect of suppressing an increase in residual potential was confirmed, it is not sufficient to provide basic solution to the problem. An increase in residual potential when filler is contained may possibly be caused by the charge trap or the dispersibility of the filler due to presence of the filler, rather than by the charge generating efficiency. The transparency may be ensured by improving the dispersibility even when the average particle diameter of the filler is 0.3 $\mu$m or more, while transparency of the film is sacrificed when the filler is rather coagulated even when an average particle diameter is 0.3 $\mu$m or less.

Other means for suppressing the rise in residual potential include: addition of Lewis acid or the like in the protective layer (Japanese Patent Application Laid-Open No. 53-133444); addition of organic protonic acid in the protective layer (Japanese Patent Application Laid-Open No. 55-157748); addition of electron receiving material (Japanese Patent Application Laid-Open No. 2-4275); and addition of wax having acid value of 5 (mgKOH/g) or less (Japanese Patent Application Laid-Open No. 2000-66434). These methods conceivably are based on observation that charge easily reaches the surface when charge injecting property is improved at the interface of protective layer/charge transporting layer and forming of a low resistant portion in the protective layer. Although the effect of reducing the residual potential is confirmed in these methods, they have a side effect such as image blurring and the like to clearly show in the image. Further, addition of an organic acid tends to cause deterioration in dispersibility of the filler, and its effect is insufficient to solve the problem.

To realize a higher image quality in an electrophotographic photoconductor containing filler to improve durability, it is important not only to suppress the image blurring or rise in residual potential, but also for the charge to linearly reach the surface of the photoconductor without being disturbed by the filler in the protective layer. The dispersibility of the filler in the protective layer film has a great influence on the wear resistance. When the charge injected to the protective layer from the charge transporting layer moves to the surface of the protective layer, the move of the charge may be disturbed by the filler coagulated, thus the dot formed by the toner is dispersed, and consequently deteriorates resolution. When the protective layer is provided, the light transmitting property tends to deteriorate due to scattering of the recording light by the filler. Such phenomenon also has a serious adverse effect on the resolution. The influence on the light transmitting property is also closely related to the dispersibility of the filler. The dispersibility of the filler also has a great influence on the wear resistance. The filler when highly coagulated will affect wear resistance due to poor dispersibility. Accordingly, to achieve high image quality simultaneously with high durability in an electrophotographic photoconductor having a protective layer containing the filler for improvement of durability, it is important not only to suppress the image blurring or rise in residual potential, but also to improve dispersibility of the filler in the protective layer film.

Effective means for solving both of the problems at the same time have not been presented as of today. When the filler is contained in the protective layer of the electrophotographic photoconductor to improve durability, the influence of image blurring or rise in residual potential is caused, leaving the problem of image quality improvement unsolved. Further, improvement in durability of a electrophotographic photoconductor having small diameter which requires highest durability from the standpoint of loading the drum heater in order to reduce such influence has not been realized, thus making downsizing of the device, and reduction of power consumption, difficult.

Organic photoconductors which has been surpassing inorganic photoconductors in terms of photosensitivity, spectral sensitivity range, non-pollution property, electrostatic durability and the like, the improvement in mechanical durability is a pressing need to fully utilize their advantages, and the development of such organic photoconductors having improved mechanical strength has been desired for use in highly durable machines and process designs.

When the life of the photoconductor is free from image scraping as the result of improvement in wear resistance of the photoconductor, the life of the photoconductor depends on the electrostatic life of the electrophotographic photoconductor. Concretely, the reduction in electrostatic property of the electrophotographic photoconductor (particularly, local potential leak) causes a defect appearing as spots (toner deposition on the background of images, black spot, etc.) in a surface portion (white) which is not present on a document to be copied. Such defect is often mistaken as a dot in a drawing or a period, comma or the like in an English document, and may be a fatal defect of image.

As described above, the toner and photoconductor used for an image forming method aiming at high transfer ability are required to have excellent releasability. In Japanese Patent Application Laid-Open No. 11-272003 or the like, an electrophotographic photoconductor characterized by having a large contact angle of the outermost layer surface of the electrophotographic photoconductor with pure water is proposed. However, even if the contact angle of the outermost layer surface of the electrophotographic photoconductor with pure water is increased, there is no correlation of releasability of the toner to the electrophotographic photoconductor in actual situations, further, such electrophotographic photoconductor has insufficient transfer ability and cleanability and requires a further improvement.

SUMMARY OF THE INVENTION

The present invention has an object to provide a method for forming an electrophotographic image and electrophotographic device using the toner and electrophotographic photoconductor in which the problems of the related art are solved.

Namely, the present invention has an object to provide a method for forming an electrophotographic image and electrophotographic device using a toner excellent in transfer property to minimize generation of the toner remained untransferred and never causes filming onto a cleaning member or on the photoconductor or capable of suppressing these phenomena, and to provide a method for forming an electrophotographic image and electrophotographic device using a photoconductor having long-life, excellent in releasability and slidability to minimize scraping even after long-term use and repeated printing.

As a result of the earnest studies to achieve above mentioned objects, focusing to releasability of the photoconductor to the toner, the present inventors attained the present invention.

According to the present invention, method for forming electrophotographic image as described in the following 1–10 and electrophotographic device described in 11–25 are provided.

In a method for forming electrophotographic image and an electrophotographic device of the present invention, a toner having a total surface area ratio X of additive of 0.5–1.5 and a photoconductor comprising a filler-containing protective layer on a photosensitive layer are used, and the angle of repose of the toner to the protective layer surface of the photoconductor is set to 30° or less, whereby the filming on the cleaning member and the filming on the photoconductor are never caused, and the scraping of photoconductor is remarkably reduced.

The toner to be used preferably has a roundness of 0.95 or more. The filler contained in the protective layer of the photoconductor preferably comprises an inorganic pigment or metal oxide having a specific resistance of $1\times10^{10}$ Ω·cm or more.

The protective layer preferably contains a charge transporting material, and the charge transporting material preferably comprises a polymer having electron-donating group. The protective layer also preferably contains an organic compound having acid value of 10–400 (mgKOH/g). An excessive amount of silicone oil is preferably added to the outermost layer of the photoconductor, and the charge generating material contained in the photoconductor preferably comprises a titanyl phthalocyanine specified above or an azo pigment represented by the general formula (A). Further, the conductive support surface of the photoconductor is preferably anodized.

DESCRIPTION OF THE PREFERED EMBODIMENTS

Figure 1:
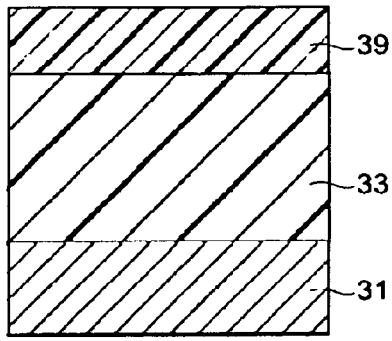
FIG. 1 is a typical cross-sectional view showing a structural example of an electrophotographic photoconductor of the present invention.

The present invention is further described in detail.

An electrostatic latent image developer toner of the present invention at least comprises a toner particle and at least one additive, and the toner particle contains a binder resin and a coloring agent.

(Toner Particle and Additive)

The toner of the present invention is required to have a total surface area ratio Z of additive in the toner, calculated by $Z=(Ht\cdot Wt)/(H\cdot W)$, satisfying $0.5\leqq Z\leqq 1.5$, and having an angle of repose of the toner to the filler-containing outermost layer surface of a photoconductor used for an electrophotographic imaging method for recovering the residual toner in the step for cleaning.

The above reference marks represent the following numerical values.

H: Specific surface area of toner particles ($m^2/g$)

W: Weight content of toner particles (%)

Ht: Specific area of additives ($m^2/g$)

Wt: Content ratio of additives (%)

The specific surface area mentioned herein means a specific surface area measured using a specific surface area measuring instrument [MONOSORB MS-12 made by YUASA IONICS] according to BET method.

When the total surface area ratio Z is Z<0.5, it is difficult that the angle of repose of the toner to the protective layer surface of the photoconductor satisfies 30° or less, and the use of such a toner in the one-component developing method causes a toner supply failure by insufficient toner fluidity. When the total surface area ratio Z is 1.5<Z, the angle of repose of the toner to the protective surface layer of the photoconductor substantially satisfies less than 30°, but the filming to cleaning member and thin layer regulating member occurs. Further, the filming to photoconductor occurs, too, and the scraping of photoconductor is deteriorated after long-term and many-sheet printing to remarkably shorten the life of the photoconductor.

When the angle of repose of the toner to the protective layer surface of the photoconductor exceeds 30°, the deterioration in the toner and the photoconductor are caused.

The fluidity (the angle of repose of toner) referred to in the present invention is determined as follows. A sample (100 g) on a sieve is fallen by gravity with vibration and filled in a cylindrical vessel 5 cm in height and 5 cm in diameter, then the toner which exceeds the surface of the cylindrical vessel is removed, and a flat aluminum plate formed by coating the protective layer surface of the photoconductor is places on the cylindrical vessel filled with toner. The cylindrical vessel is turned upside down while being closely fitted to the coated flat aluminum plate, and gently pulled up. The angle of repose of the accumulated sample of toner formed at this time is determined.

As the additives of the toner in the present invention, known additives such as inorganic fine particle, organic fine particles and the like may be used. Among them, inorganic fine particles such as silica, titania, alumina, cerium oxide, strontium titanate, calcium carbonate, magnesium carbonate, calcium phosphate, etc., and organic fine particles such as fluorine-containing resin fine particle, silica-containing resin fine particle, nitrogen-containing resin fine particle, etc. are preferably used. The additive surface may be subjected to surface treatment according to purposes. The surface treatment agents include silane compounds, silane coupling agents, and silicone oil for performing hydrophobic treatment, and the like.

Further, it is preferable to include at least two additives differed in particle diameter from the point of preventing the deterioration of toner fluidity caused by the burying of the additive to the toner parent body with a lapse of time to prevent the resulting image unevenness, and from the point of enhancing the adhesive force to the toner to prevent the separation of the additives from the toner which causes a sensitive material flaw and an image omission. Such additives preferably have a particle diameter difference of about 2–5 times in average particle diameter. When at least two additives differed in particle diameter are included, the additive with major particle diameter plays a role of a spacer to prevent the additive with minor particle diameter effective for toner fluidity from being buried in the toner parent body, and the toner fluidity can be kept.

The additive with large particle diameter means a one having a BET specific surface area of 20–80 $m^2/g$. Various surface-treated ones may be used when their BET specific surface areas are within this range, and a one with 20–50 $m^2/g$ is more preferable. When the BET specific surface area is less than 20 $m^2/g$, the image unevenness resulted from the deterioration in toner fluidity is apt to occur, and it is difficult to improve the adhesive force to the toner, and the separation from the toner easily occurs, causing the sensitive material flaw and image omission. The additive with small particle diameter means a one having a BET specific surface area of 100–250 $m^2/g$, and various surface-treated ones may be used when their BET specific surface areas are within this range. A one with 120–200 $m^2/g$ is more preferable because it is effective, particularly, for reducing the adhesive force of the toner.

(Parent Toner Particle)

The parent toner particle of the present invention preferably has a roundness of 0.95 or more. A toner produced by an air pulverization method, which is conventionally mainly used, has a highly irregular shape. The lightly fused toner in the early stage is scraped off from the photoconductor body by the abrasive force resulted from the irregularities, so that the fusion is relatively less developed to a serious level. The toner of the present invention has a rounded shape, compared with the toner produced by the conventional air pulverization method, and it is assumed that the fusion is hardly caused under a sever condition because the abrasive property of the toner particle itself is reduced. As the reason, the frictional resistance of the toner with the photoconductor is conceivably reduced to reduce the frictional heat generated, so that the fusion is not developed.

The measurement of roundness in the present invention is performed using a flow type particle image analyzer (FPIA-1000) made by TOA DENSHI.

The preparation of a parent toner particle having a roundness of 0.95 or more can be prepared by an emulsion polymerization coagulation method of polymerizing a polymeric monomer of a binder resin by emulsion polymerization and mixing the resulting dispersion with a coloring agent and, as necessary, a dispersion of release agent, static controlling agent, offset preventing agent, and the like followed by coagulation and fusing to obtain the toner particle; a suspension polymerization method of suspending a polymeric monomer for obtaining the binder resin, a coloring agent and, as necessary, a solution of release agent, static controlling agent, offset preventing agent, and the like to an aqueous solvent followed by polymerization; a solution suspension method of suspending a binder resin, a coloring agent and, as necessary, a solution of release agent, static controlling agent, offset preventing agent, and the like to an aqueous solvent followed by pelletization; and the like. A kneading pulverization method of kneading a binder resin with a coloring agent and, as necessary, a release agent, a static controlling agent, an offset preventing agent, and the like followed by pulverization and classification is also adaptable. Further, in the preparation, a thermal energy may be imparted to an amorphous toner particle obtained by the gas pulverization to change the shape, or a flock may be further adhered to the toner particle obtained by the above method as a core followed by fusing to impart a core shell structure.

The binder resins used for the preparation of the toner particle in the present invention include single polymers or copolymers of styrenes such as styrene and chlorostyrene; monoolefins such as ethylene, propylene, butylenes, and isoprene; vinyl esters such as vinyl acetate, vinyl propionate, vinyl benzoate, and vinyl lactate; α-methylene aliphatic monocarboxylates such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl ethers such as vinyl methyl ether, vinyl ethyl ether and vinyl butyl ether; vinyl ketones such as vinyl methyl ketone, vinyl hexyl ketone and vinyl isopropenyl ketone; and the like. Particularly, typical binder resins include polystyrene, styrene-acrylic alkyl copolymer, styrene-methacrylic alkyl copolymer, styrene-acrylonitrile copolymer, styrene-butadiene copolymer, styrene-maleic anhydride copolymer, polyethylene, polypropylene, and the like. Further, polyester, polyurethane, epoxy resin, silicone resin, polyamide, modified rosin, paraffin wax and the like are also usable.

The typical coloring agents used for the preparation of the toner particle in the present invention include dyes and pigments such as carbon black, aniline blue, chalcoyl blue, chromium yellow, ultra marine blue, de Pont oil red, quinoline yellow, methylene blue chloride, phthalocyanine blue, malachite green oxalate, lamp black, rose Bengal, C.I. pigment·red 48: 1, C.I. pigment·red 122, C.I. pigment·red 57:1, C.I. pigment·yellow 97, C.I. pigment·yellow 17, C.I. pigment·blue 15:1, C.I. pigment·blue 15:3, and the like.

To the toner particle of the present invention, a release agent for preventing offset may be added as necessary in addition to the binder resin and the coloring agent. Such release agents include waxes such as low molecular polypropylene, low molecular polyethylene, and the like. As the static controlling agent, known ones may be used. Among them, an azo-based metal complex compound or a metal complex compound of salicylic acid can be suitably used.

The toner particle of the invention preferably has an average particle diameter of 5–11 $\mu$m similarly to general toner particles, and the range of 4–8 $\mu$m is more preferable. When the average particle diameter exceeds 11 $\mu$m, the toner particle is not faithfully developed to latent images of dot and line, often deteriorating the reproduction of a photographic image or the reproduction of a fine line. When the average particle diameter is less than 3 $\mu$m, the surface area per toner unit is increased to make the control of electrostatic property and toner fluidity, and a stable image cannot be often obtained.

The average particle diameter and particle diameter distribution of the toner in the present invention are determined using a Coulter counter TA-II or Coulter multiple sizer (made by COULTER) or the like.

An electrophotographic photoconductor of the present invention is further described with reference to the drawings.

FIG. 1 is a typical cross-sectional view showing a structural example of the electrophotographic photoconductor of the present invention, wherein a single layer photosensitive layer 33 mainly comprised of a charge generating material and a charge transporting material is provided on a conductive support 31, and a protective layer 39 is provided on the photosensitive layer.

Figure 2:
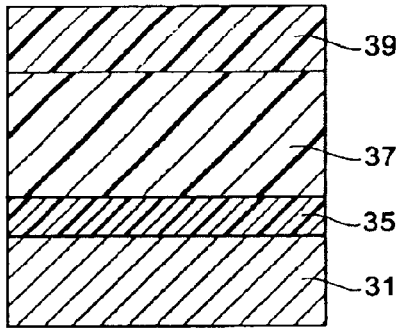
FIG. 2 is a typical cross-sectional view showing another structural example of the electrophotographic photoconductor of the present invention.

FIG. 2 is a typical cross-sectional view showing another structural example of the electrophotographic photoconductor of the present invention, wherein the photosensitive layer has a laminated structure of a charge generating layer 35 mainly comprised of a charge generating material and a charge transporting layer 37 mainly comprised of a charge transporting material, and a protective layer 39 is provided on the charge transporting layer 37.

Figure 3:
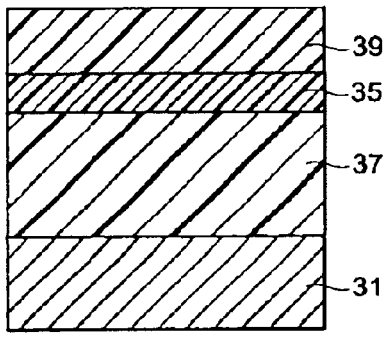
FIG. 3 is a typical cross-sectional view showing the other structural example of the electrophotographic photoconductor of the present invention.

FIG. 3 is a typical cross-sectional view showing the other structural example of the electrophotographic photoconductor of the present invention, wherein the photosensitive layer has a laminated structure of the charge transporting layer 37 mainly comprised of a charge transporting material and the charge generating layer 35 mainly comprised of a charge generating material, and the protective layer 39 is provided on the charge generating layer 35.

As the conductive support 31, a film-like or cylindrical plastic or paper covered with a material showing conductivity of volume resistance $10^{10}$ Ω·cm or less, for example, a metal such as aluminum, nickel, chromium, nichrome, copper, gold, silver, platinum, etc. or a metal oxide such as tin oxide, indium oxide, etc. by evaporation or sputtering, a plate such as aluminum, aluminum alloy, nickel, stainless or the like, or a pipe obtained by forming the plate into a crude pipe followed by surface treatment such as cutting, super finishing, polishing or the like may be used. An endless nickel belt and endless stainless belt disclosed in Japanese Patent Application Laid-Open No. 52-36016 are also usable as the conductive support 31.

Among them, a cylindrical support consisting of aluminum, which is easy to anodize, can be used most preferably. The aluminum referred herein includes both pure aluminum series and aluminum alloys. Concretely, aluminums or aluminum alloys of JIS 1000, 3000 and 6000 series are most suitable. The anodic oxide films are obtained by anodizing various metals and various alloys in an electrolytic solution. Among them, particularly, a film called alumite obtained by anodizing aluminum or an aluminum alloy in an electrolytic solution is most suitable for the photoconductor of the present invention. This is particularly excellent in the point of preventing a spot defect (black spot, toner deposition on the background of images) generated in the use for reverse development (negative and positive developments).

The anodic treatment is performed in an acidic bath of chromic acid, sulfuric acid, silicic acid, phosphoric acid, boric acid, sulfamic acid or the like. Among them, the sulfuric acid bath is most suitable for the treatment. The treatment is performed, for example, within the ranges of sulfuric acid: 10–20%, bath temperature:5–25° C., current density: 1–4 A/dm$^2$, electrolytic voltage: 5–30 V, and treatment time: about 5–60 min, but is not limited. Since the thus-prepared anodic oxide film is porous and has high insulating property, the surface thereof is in an extremely unstable state. Therefore, the physical values of the anodic oxide film are apt to change by the change with time after the preparation. To avoid it, the anodic oxide film is desirably further sealed. The sealing treatment can be performed by dipping the anodic oxide film in an aqueous solution containing nickel fluoride or nickel acetate, by dipping the anodic oxide film in boiling water; treating the film with pressurized steam, or the like. Among these methods, the dipping in the aqueous solution containing nickel acetate is mote preferable. The washing treatment of the anodic oxide film is performed successively to the sealing treatment. This is performed mainly for the purpose of removing the excess of a metal salt adhered by the sealing treatment. When the metal salt is excessively left on the surface of the support (anodic oxide film), it does not affect the quality of a coating formed thereon but reversely causes a toner deposition on the background of images because the low resistance component is generally left. The washing is generally in multiple stages although one washing with pure water is sufficient. The final washing solution is preferably as clean as possible (deionized). In one process of the multistage washing processes, a physical rubbing washing with a contact member is desirably performed. The thickness of the thus-formed anodic oxide film is desirably is in the range of 5–15 $\mu$m. When it is smaller than this range, the effect of barrier property as anodic oxide film is insufficient, and when it exceeds this range, the time constant as electrode is too large, often generating a residual potential or deteriorating the responsiveness of the photoconductor.

Further, in the present invention, a conductive support 31 formed by coating a support with a conductive powder dispersed in an appropriate binder resin may also be used. Such conductive powders include carbon black, acetylene black, metal powder of aluminum, nickel, iron, nichrome, copper, zinc, silver, etc., and a metal oxide powder such as conductive tin oxide, ITO, etc. The binder resins used together include thermoplastic and thermosetting resins or photo-curing resins such as polystyrene, styrene-acrylonitrile copolymer, styrene-butadiene copolymer, styrene-maleic anhydride copolymer, polyester, polyvinyl chloride, polyvinyl chloride-vinyl acetate copolymer, polyvinyl acetate, polyvinylidene chloride, polyacrylate resin, phenoxy resin, polycarbonate, cellulose acetate resin, ethyl cellulose resin, polyvinyl butyral, polyvinyl formal, polyvinyl toluene, poly-N-vinyl carbazole, acrylic resin, silicone resin, epoxy resin, melamine resin, urethane resin, phenolic resin, alkyd resin and the like. Such a conductive layer can be provided by dispersing the conductive powder and the binder resin in an appropriate solvent, e.g., tetrahydrofurane, dichloromethane, methyl ethyl ketone, toluene, or the like and applied.

Further, a support comprising a conductive layer on a appropriate cylinder using a thermally shrinkable tube containing the conductive powder in a material such as polyvinyl chloride, polypropylene, polyester, polystyrene, polyvinylidene chloride, polyethylene, rubber chloride, polytetrafluoro-ethylene or the like may also be used as the conductive support 31 of the present invention.

The photosensitive layer will be described hereinafter. The photosensitive layer may be formed of a single layer or a laminated structure, and those formed of charge generating layer 35 and the charge transporting layer 37 will be described first.

The charge generating layer 35 is mainly comprised of a charge generating material, and a binder resin is often used as necessary. As the charge generating material, inorganic materials and organic materials may be used.

The inorganic materials include crystal selenium, amorphous selenium, selenium-tellurium, selenium-tellurium-halogen, selenium-arsenic compound, amorphous silicon, and the like. For the amorphous silicon, the one having a dangling bond terminated with hydrogen atom or halogen atom, or the one doped with boron atom, phosphor atom or the like may suitably be used.

As the organic materials, known materials for example, a phthalocyanine-based pigment such as metal phthalocyanine, organic phthalocyanine, etc., an azurenium salt pigment; a squaric acid methane pigment, an azo pigments having carbazole frame, an azo pigment having triphenyl amine frame, an azo pigment having diphenylamine frame, an azo pigment having benzothiophene frame, an azo pigment having fluorenon frame, an azo pigment having distyryl oxadiazole frame, an azo pigment having distyryl carbazole frame, a perylene-based pigment, an anthraquinone-based or polycyclic quinone-based pigment, a quinone imine-based pigment, diphenylmethane and triphenylmethane-based pigments, benzoquinone and naphthoquinone-based pigments, cyanine and azomethine-based pigments, an indigoide-based pigment, a bisbenzimidazo10based pigment, and the like may be used. Such charge generating materials can be used independently or in combination of two or more.

Among them, the azo pigment and/or phthalocyanine pigment are effectively used. Particularly, an azo pigment represented by the following general formula (A) and a titanyl phthalocyanine (particularly, having a maximum diffraction peak at least at 27.2° as the diffraction peak (±0.2°) of Bragg angle 2θ to characteristic X-rays (wavelength 1.542 Å) of CuKα) may suitably be used.

(A)

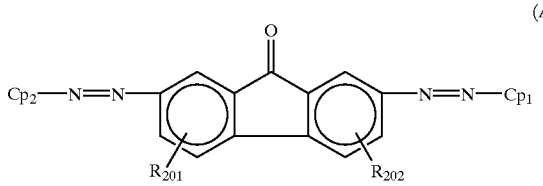

[in the formula (A), $Cp_1$ and $Cp_2$, which may be the same or different, each representing a coupler residual group; $R_{201}$ and $R_{202}$, which may be the same or different, each represents any one of hydrogen atom, a halogen atom, an alkyl group, an alkoxyl group and a cyano group, and $Cp_1$ and $Cp_2$ are groups represented by the following general formula (B):

(B)

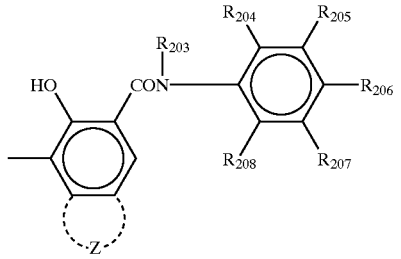

(in the formula (B), $R_{203}$ represents hydrogen atom, an alkyl group such as methyl group, ethyl group, etc., or an aryl group such as phenyl group, etc.; $R_{204}$, $R_{205}$, $R_{206}$, $R_{207}$, and $R_{208}$ each represent hydrogen atom, nitro group, cyano group, a halogen atom such as fluorine, chlorine, bromine, iodine, etc., an alkyl group such as trifluoromethyl group, methyl group, ethyl group, etc., an alkoxyl group such as methoxy group, ethoxy group, etc., a dialkylamino group, or hydroxyl group; and X represents an atom group necessary for constituting a substituted or non-substituted aromatic carbocyclic residue or a substituted or non-substituted aromatic heterocyclic residue.)]

Particularly, an asymmetric azo pigment having a structure in which $Cp_1$ is differed from $Cp_2$ generally satisfies photosensitivity more than a symmetric azo pigment having a structure in which $Cp_1$ is the same as $Cp_2$, conformable to the reduction in diameter of the photoconductor and the speeding up of the process.

Among the titanyl phthalocyanines having maximum diffraction peaks at least at 27.2° as the diffraction peak (±0.2°) of Bragg 2θ, a titanyl phthalocyanine further having essential peaks at 9.4°, 9.6°, and 24.0° and having a peak at 7.3° as the lowest angle-side peak without having any peak in the range of 7.4–9.4° or having a peak at 26.3° (described in Japanese Patent Application Laid-Open No. 2001-19871) is particularly effective for use.

These charge generating materials may be used independently or in combination of two or more.

The binder resin used for the charge generating layer 35 as necessary includes polyamide, polyurethane, epoxy resin, polyketone, polycarbonate, silicone resin, arylic resin, polyvinyl butyral, polyvinyl formal, polyvinyl ketone, polystyrene, polysulfone, poly-N-vinyl carbazole, polyacrylamide, polyvinyl benzale, polyester, phenoxy resin, vinyl chloride-vinyl acetate copolymer, polyvinyl acetate, polyphenylene oxide, polyamide, polyvinyl pyridine, cellulose resin, casein, polyvinyl alcohol, polyvinyl pyrolidone, and the like. The amount of the binder resin against 100 parts by weight of the charge generating material is suitably determined at 0–500 parts by weight, and preferably 10–300 parts by weight.

The method for forming the charge generating layer 35 can be generally divided into a vacuum thin film forming method and a casting method of the materials dispersed in solution.

For the former method, vacuum evaporation, glow-discharge decomposition, ion plating, sputtering, reactive sputtering, CVD and the like are used, and the above-mentioned inorganic materials and organic materials may suitably be used for the formation of the charge generating layer 35.

The charge generating layer by the latter casting method can be formed by dispersing the above-mentioned charge generating inorganic or organic material with a binder resin as necessary using a solvent such as tetrahydrofurane, cyclohexane, dichloroethane, butanone, etc. by a ball mill, an attoritor, a sand mill or the like, and properly diluting and applying the resulting dispersant. For coating application, dip coating, spray coating, bead coating, nozzle coating, spinner coating, ring coating or the like may be used.

The appropriate thickness of the charge generating layer 35 is about 0.01–5 $\mu$m, preferably 0.1–2 $\mu$m.

The charge transporting layer 37 can be formed by dissolving or dispersing the charge transporting material and the binder resin in an appropriate solvent, and applying the resulting solution after drying. As necessary, a plasticizer, a leveling agent, an antioxidant and the like may be added thereto.

The charge transporting materials include hole transport materials and electron transport materials. The electron transport materials include electron accepting materials such as chloroanil, bromoanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2,-b]thiophene-4-on, 1,3,7-trinitrodibenzothiophene-5,5-dioxide, benzoquinone derivative, and the like.

The hole transport materials include poly-N-vinyl carbazole and derivatives thereof, poly-γ-carbazolylethyl glutamate and derivatives thereof, pyrene-formaldehyde condensate and derivatives thereof, polyvinylpyrene, polyvinylphenanthrene, polysilane, oxazole derivatives, oxadiazole derivatives, imidazole derivatives, monoarylamine derivatives, diarylamine derivatives, triarylamine derivatives, stilbene derivatives, α-phenyl stilbene, benzidine derivatives, diaryl methane derivatives, triaryl methane derivatives, 9-styrylanthracene derivatives, pyrazoline derivatives, divinyl benzene derivatives, hydrazone derivatives, indene derivatives, butadiene derivatives, pyrene derivatives, bisstilbene derivatives, enamine derivative, etc., and other known materials. These charge transporting materials may be used independently or in combination of two or more.

The binder resins include thermoplastic and thermosetting resins such as polystyrene, styrene-acrylonitrile copolymer, styrene-butadiene copolymer, styrene-maleic anhydride copolymer, polyester, polyvinyl chloride, polyvinyl chloride-vinyl acetate copolymer, polyvinyl acetate, polyvinlydene chloride, polyarate, phenoxy resin, polycarbonate, cellulose acetate resin, polyvinyl butyral, polyvinyl formal, polyvinyl toluene, poly-N-vinylcarbazole, acrylic resin, silicone resin, epoxy resin, melamine resin, urethane resin, phenolic resin, alkyd resin and the like.

The amount of the charge transporting material is properly determined at 20–300 parts by weight, preferably 40–150 parts by weight to 100 parts by weight of the binder resin. The thickness of the charge transporting layer is preferably determined in the range of about 5–100 $\mu$m. The solvents used herein include tetrahydrofurane, dioxane, toluene, dichloromethane, monochlorobenzene, dichloroethane, cyclohexane, methyl ethyl ketone, acetone and the like.

A polymer having electron-donating group may be contained in the charge transporting layer. The polymers having electron-donating group include a high molecular charge transporting material having the function of charge transporting material and the function of binder resin, or a polymer laid in a monomer or oligomer state having electron-donating group at the time of film forming the charge transporting layer and finally having a two-dimensional or three-dimensional cross-linked structure by being hardened or cross-linked after film forming.

The charge transporting layer formed of such a polymer having electron-donating group or the polymer having the cross-linked structure exhibit excellent wear resistance. The charge potential (unexposed part potential) is generally constant in electrophotographic process. Accordingly, when the surface layer of the photoconductor wears out in repeated use, the field intensity applied on the photoconductor increases as much. Since toner deposition on the background of images increases with rise in the field intensity, the high wear resistance of the photoconductor is advantageous to prevent such phenomenon. The charge transporting layer formed by a polymer having electron-donating group exhibits excellent film forming property since the polymer itself is a high molecular compound, and may be able to form a charge transporting portion at high density, compared to the charge transporting layer consisting of a low molecular dispersion-type polymer, and is excellent in charge transporting ability. Therefore, high-speed response may be expected for photoconductors having the charge transporting layer comprising high molecular charge transporting material.

Known materials may be used for the polymer charge transporting material, and, particularly, polycarbonates containing triarylamine structure in the main chain and/or side chain are preferably used. High molecular charge transporting materials represented by the following general formulae (I)–(X) are particularly suitable. These materials will be described using concrete examples.

<Compound Represented by General Formula (I)>

(I)

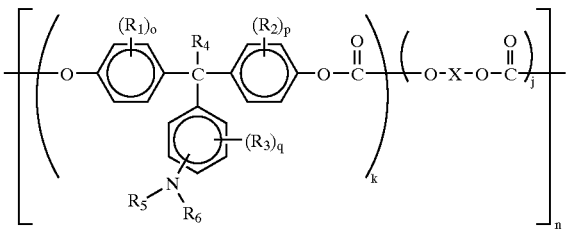

[wherein $R_1$, $R_2$, and $R_3$ each independently represent a substituted or non-substituted alkyl group or halogen atom; $R_4$ represents hydrogen atom or a substituted or non-substituted alkyl group; $R_5$ and $R_6$ each represent a substituted or non-substituted aryl group; o, p and q each independently represent an integer of 0–4; k and j represent compositions and are $0.1 \leqq k \leqq 1$ and $0 \leqq j \leqq 0.9$; n represents the number of repeated units and is an integer of 5–5000; and X represents an aliphatic divalent group, an alicyclic divalent group, or a divalent group represented by the following general formula (a):

(a)

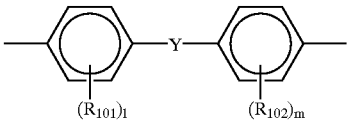

{wherein $R_{101}$ and $R_{101}$ each independently represent a substituted or non-substituted alkyl group, an aryl group, or a halogen atom; 1 and m each represent an integer of 0–4; Y represents a single bond, a straight, branched, or cyclic alkylene group having 1–12 carbon atoms, —O—, —S—, —SO—, $SO_2$—, —CO—, —CO—O—Z—O—CO— (wherein Z represents an aliphatic divalent group), or a divalent group represented by the following general formula (b):

(b)

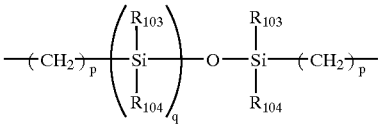

(wherein p is an integer of 1–20; q is an integer of 1–2000; $R_{103}$ and $R_{104}$ each represent a substituted or non-substituted alkyl group or aryl group), and $R_{101}$ and $R_{102}$; $R_{103}$ and $R_{104}$ may be mutually the same or different.}]

<Compound Represented by General Formula (II)>

(II)

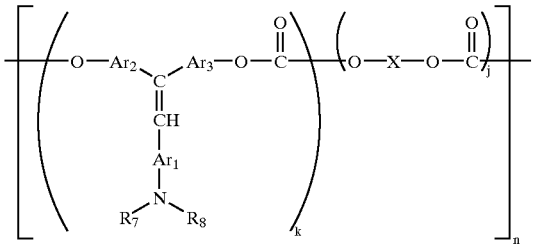

(wherein $R_7$ and $R_8$ each represent a substituted or non-substituted aryl group, $Ar_1$, $Ar_2$, and $Ar_3$, which may be the same or different, each represent an arylene group; and X, k, j and n are the same as in the general formula (I)).

<Compound Represented by General Formula (III)>

(III)

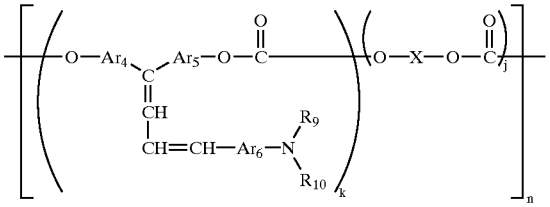

(wherein $R_9$ and $R_{10}$ each represent a substituted or non-substituted aryl group; $Ar_4$, $Ar_5$ and $Ar_6$, which may be the same or different, each represent an arylene group; and X, k, j and n are the same as in the general formula (I)).

<Compound Represented by General Formula (IV)>

(IV)

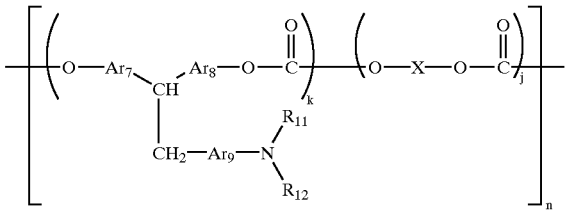

(wherein $R_{11}$ and $R_{12}$ represent a substituted or non-substituted aryl group; $Ar_7$, $Ar_8$ and $Ar_9$, which may be the same or different, each represent an arylene group; and X, k, j and n are the same as in the general formula (I)).

<Compound Represented by General Formula (V)>

(V)

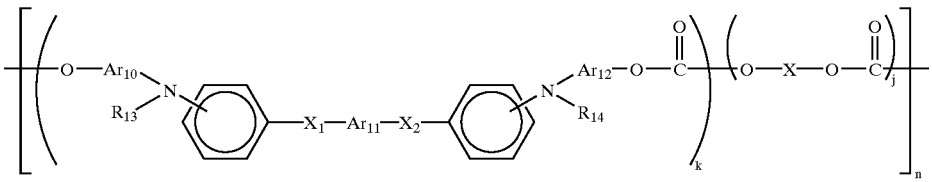

(wherein $R_{13}$ and $R_{14}$ each represent a substituted or non-substituted aryl group; $Ar_{10}$, $Ar_{11}$ and $Ar_{12}$, which may be the same or different, each represent an arylene group; $X_1$ and $X_2$ each represent a substituted or non-substituted ethylene group or a substituted or non-substituted vinylene group; and X, k, j and n are the same as in the general formula (I)).

<Compound Represented by General Formula (VI)

(VI)

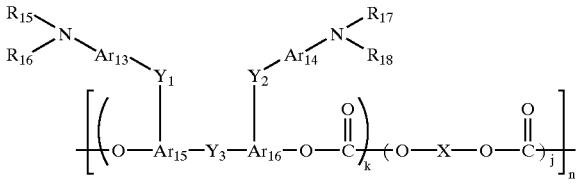

(wherein $R_{15}$, $R_{16}$, $R_{17}$, and $R_{18}$ each represent a substituted or non-substituted aryl group; $Ar_{13}$, $Ar_{14}$, $Ar_{15}$, and $Ar_{16}$, which may be the same or different, each represent an arylene group; $Y_1$, $Y_2$ and $Y_3$, which may be the same or different, each represent a single bond, a substituted or non-substituted alkylene group, a substituted or non-substituted cycloalkylene group, a substituted or non-substituted alkylene ether group, oxygen atom, sulfur atom, or a vinylene group; and X, k, j and n are the same as in the general formula (I)).

<Compound Represented by General Formula (VII)>

(VII)

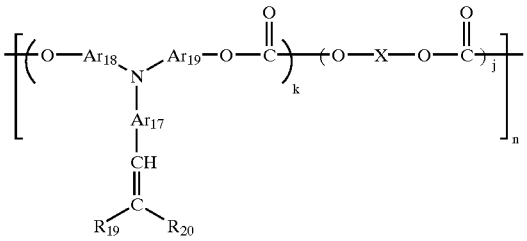

(wherein $R_{19}$ and $R_{20}$ each represent hydrogen atom or a substituted or non-substituted aryl group and may form a ring; $Ar_{17}$, $Ar_{18}$ and $Ar_{19}$, which may be the same or different, each represent an arylene group; and X, k, j and n are the same as in the general formula (I)).

<Compound Represented by General Formula (VIII)>

(VIII)

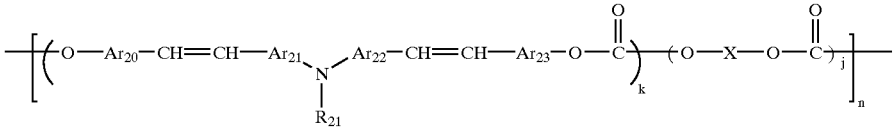

(wherein $R_{21}$ represents a substituted or non-substituted aryl group; $Ar_{20}$, $Ar_{21}$, $Ar_{22}$, and $Ar_{23}$, which are the same or different, each represent an arylene group; and X, k, j and n are the same as in the general formula (I)).

<Compound Represented by General Formula (IX)>

(IX)

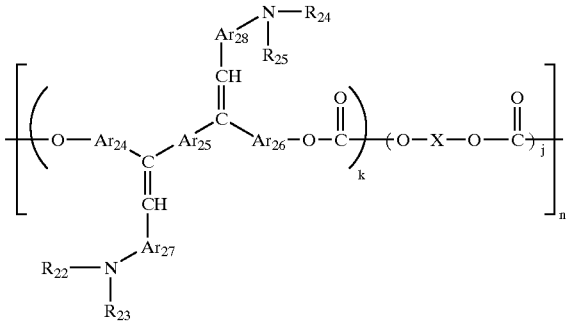

(wherein $R_{22}$, $R_{23}$, $R_{24}$ and $R_{25}$ each represent a substituted or non-substituted aryl group; $Ar_{24}$, $Ar_{25}$, $Ar_{26}$, $Ar_{27}$ and $Ar_{28}$, which may be the same or different, each represent an arylene group; and X, k, j and n are the same as in the general formula (I)).

<Compound Represented by General Formula (X)>

(X)

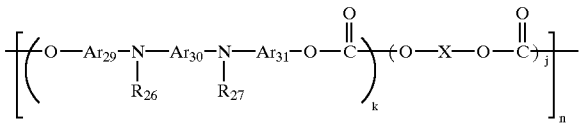

(wherein $R_{26}$ and $R_{27}$ each represent a substituted or non-substituted aryl group; $Ar_{29}$, $Ar_{30}$ and $Ar_{31}$, which may be the same or different, each represent an arylene group; and X, k, j and n are the same as in the general formula (I)).

These high molecular charge transporting materials may be used independently or in combination of two or more of other high molecular charge transporting materials. Also a low molecular charge transporting material can be used together. As other polymers having electron-donating group, copolymers, block polymers, graft polymers, star polymers of known monomers, or cross-linked polymers having electron-donating group as disclosed in Japanese Patent Application Laid-Open Nos. 3-109406, 2000-206723, and 2001-34001 may be used.

In the photoconductor of the present invention, a plasticizer or leveling agent may be added to the charge transporting layer 37. As the plasticizer, a one generally used as resin plasticizer such as dibutyl phthalate, dioctyl phthalate or the like is usable as it is, and the appropriate use quantity thereof is about 0–30 wt % to the binder resin. As the leveling agent, a silicone oil such as dimethyl silicone oil, methylphenyl silicone oil, etc. or a polymer or oligomer having perfluoroalkyl group on the side chain is used, and the appropriate using quantity thereof is 0–1 wt % to the binder resin.

When the photosensitive layer has a single-layer structure 33, a photosensitive layer having at least the above-mentioned charge generating material dispersed in the binder resin can be used. The single-layer photosensitive layer is formed by dissolving or dispersing the charge generating material and the binder resin to an appropriate solvent, and applying the resulting solution and dried. Also, the photosensitive layer may be formed into function separating type by adding the charge transporting material. Further, a plasticizer, a leveling agent, an antioxidant and the like may be added as required.

As the binder resin, the binder resins described in the description of the charge transporting layer 37 may be used as they are and also in combination with the binder resins described in the description for the charge generating layer 35. Of course, the high molecular charge transporting materials described above may also be used. The preferred amount of the charge generating material against 100 parts by weight of the binder resin is determined at 5–40 parts by weight, and the quantity of the charge transporting material is preferably determined at 0–190 parts by weight, more preferably, 50–150 parts by weight. The single-layer photosensitive layer can be formed by applying a coating solution obtained by dispersing the charge generating material and the binder resin with the charge transporting material if necessary, using a solvent such as tetrahydrofurane, dioxane, dichloroethane, cyclohexane, etc. in a dispersing machine or the like by means of dipping coating, spray coating, bead coating, nozzle coating, spinner coating, ring coating, or the like. The appropriate thickness of the single layer photosensitive layer is about 5–100 $\mu$m.

In the photoconductor of the present invention, an undercoat layer (not shown in the drawings) may be provided between the conductive support 31 and the photosensitive layer. The undercoat layer is generally mainly comprised of a resin. The resin desirably has high resistance to general organic solvents when application of the photoconductive layer onto the resin in a form of solvent is considered. Such resins include a water-soluble resin such as polyvinyl alcohol, casein and sodium polyacrylate; an alcohol-soluble resin such as copolymerized nylon and methoxy methylated nylon; a curable resin forming a three-dimensional mesh structure such as polyurethane, melamine resin, phenolic resin, alkyd-melamine resin and epoxy resin; and the like. Further, a fine finely powdered pigment of a metal oxide such as titanium oxide, silica, alumina, zirconium oxide, tin oxide, indium oxide, etc., may be added to the undercoat layer to prevent moire, reduction of residual potential, and the like.

The undercoat layer can be formed using an appropriate solvent and coating method as mentioned above in the description of the photosensitive layer. Further, as the undercoat layer of the present invention, a silane coupling agent, a titanium coupling agent, a chromium coupling agent or the like may be used. Moreover, for the undercoat layer of the present invention, a substance having $Al_2O_3$ provided by anodic oxidation and a substance having organics such as polyparaxylene (parylene) or the like or inorganics such as $SiO_2$, $SnO_2$, $TiO_2$, ITO, $CeO_2$, and the like provided by vacuum thin film forming method may also be used including the ones that are known. The appropriate thickness of the undercoat layer is 0–5 $\mu$m.

In the photoconductor of the present invention, the protective layer 39 is provided on the photosensitive layer for the purpose of protecting the photosensitive layer. The materials used for the protective layer include ABS resin, ACS resin, olefin-vinyl monomer copolymer, chlorinated polyether, allyl resin, phenolic resin, polyacetal, polyamide, polyamide-imide, polyacrylate, polyallylsulfone, polybutylene, poly(butylene terephthalate), polycarbonate, polyether sulfone, polyethylene, polyethylene terephthalate, polyimide, acrylic resin, polymethyl pentene, AS resin, butadiene-styrene copolymer, polyurethane, polyvinyl chloride, polyvinylidene chloride, epoxy resin and the like.

In order to improve wear resistance, a filler may be added to the protective layer 39. Such fillers include, for example, inorganic fillers represented by, titanium oxide, silica, alumina, tin oxide, zirconium oxide, potassium titanate, and the like; and, organic fillers represented by, spherical ones of fluorine resin such as polytetrafluoroethylene, cross-linked silicone resin such as cross-linked dimethylsiloxane, melamine resin, benzoguanamine resin, styrene-divinylbenzene copolymer, and the like. Among them, fillers having effect of reducing surface energy of the surface of photoconductor may be suitably used. Examples thereof include particles of fluorine resin and silicon resin. When the surface energy of the photoconductor using such fillers is reduced, effect of the present invention will show more clearly.

A filler having high electric insulating property may be appropriately (specific resistance $1\times10^{10}$ $\Omega$·cm or more) used. Of such fillers, $\alpha$-type alumina having hexagonal minute structure having high insulating property, high thermal stability and high wear resistance is particularly useful from the standpoint of suppressing image blurring and improving wear resistance.

The specific resistance of the filler of the present invention is defined as follows. Since a powder such as filler have specific resistance value varied depending on the rate of filling, the specific resistance value must be measured under fixed condition. In the present invention, the resistance rate of the fillers were measured using a device having the same structure as measuring devices shown in Japanese Patent Application Laid-Open Nos. 5-94049 (FIG. 1) and 5-113688 (FIG. 1), and the resulting values were used. In the measuring device, the electrode area is 4.0 $cm^2$. A load of 4 kg is applied to one electrode for 1 min prior to measurement, and the sample quantity is adjusted so that the electrode-to-electrode distance is 4 mm. The measurement is performed in the loading state of the weight (1 kg) of the upper electrode with an applied voltage of 100V. The measurement was performed using HIGH RESISTANCE METER (YOKOGAWA HEWLETT-PACKERD) for the region of $10^6$ $\Omega$·cm or more and using a digital multimeter (FLUKE) for the region below. The resulting specific resistance values are determined as the specific resistance value mentioned in the present invention.

The volume average particle diameter of the filler used is preferably set to the range of 0.1–2 $\mu$m, and preferably to the range of 0.3–1 $\mu$m. When the average particle diameter is too small, the wear resistance cannot be sufficiently exhibited, and when it is too large, the surface property of the coating is deteriorated, or the coating itself cannot be formed.

The average particle diameter of the filler in the present invention means a volume average particle diameter as long as it is not specially described, and determined using an ultracentrifugal automatic particle diameter distribution measuring device: CAPA-700 (made by HORIBA). It is calculated as a particle diameter (Median series) corresponding to 50% of the cumulative distribution. The respective standard deviation of simultaneously measured particles is preferably 1 $\mu$m or less. When the standard deviation exceeds this range, the particle diameter distribution is too large to clearly obtain an effect of the present invention.

The filler can be surface-treated with at least one kind of surface treatment agents, and this treatment is preferred from the viewpoint of the dispersibility of the filler. Since the deterioration in dispersibility of the filler causes not only the rise of residual potential but also the deterioration of transparency of the coating, the generation of a paint film defect, all of which might develop into a serious problem obstructing the higher durability or higher image quality. As the surface treatment agent, all surface treatment agents used in the past may be used. Among them, a surface treatment agent capable of keeping the insulating property of the filler is preferred. For example, a titanate-based coupling agent, an aluminum-based coupling agent, a zircoaluminate-based coupling agent, a higher fatty acid and the like, or mixing thereof with a silane coupling agent; $Al_2O_3$, $TiO_2$, $ZrO_2$, silicone, aluminum stearate and the like, or mixing thereof are preferable from the standpoint of dispersibility of filler and image blurring. The treatment with the silane coupling agent improves generation of image blurring, but the affect can often be suppressed by mixing the above-mentioned surface treatment agent with the silane coupling agent.

The surface treatment amount is varied depending on the average primary particle diameter of the filler used, but preferably 3–30 wt %, and more preferably, 5–20 wt %. When the surface treatment amount is less than these ranges, the effect of dispersing the filler cannot be obtained, and an excessively large amount thereof causes a remarkable rise of residual potential. The filler materials are used independently or in combination of two or more. The surface treatment amount of the filler is defined by the weight ratio of the surface treatment agent used to the filler quantity as described above.

The filler material can be dispersed using a appropriate dispersing machine. From the viewpoint of the permeability of the protective layer, the filler used is preferably dispersed to the primary particle level to minimize generation of aggregate.

A charge transporting material is preferably added to the protective layer 39 for the purpose of reducing the residual potential, improving the photosensitivity and improving the high-speed responsiveness. As the charge transporting material to be added, the low molecular charge transporting materials described in the description for the charge transporting layer 35 may be used. The above-mentioned high molecular charge transporting materials are also further preferably used from the viewpoint of improvement in wear resistance, high-speed responsiveness, and the like. When the low molecular charge transporting material is used as the charge transporting material, a concentration gradient may be provided in the protective layer. To improvement the wear resistance, reduction of concentration at the surface is an effective method. The concentration mentioned herein means the ratio of the weight of the low molecular charge transporting material to the total weight of all the materials constituting the protective layer, and the concentration gradient means to provide a gradient in the concentration so that the concentration becomes low near the surface under the weight ratio mentioned above. The use of the high molecular charge transporting material is extremely advantageous to improve the durability of the photoconductor.

The suppression of the rise in residual potential can be realized by adding an organic compound having acid value of 10–400 (mgKOH/g). The acid value mentioned herein is defined by the milligram number of potassium hydroxide required for the neutralization of the free fatty acid contained in 1 g. As the organic compound having acid value of 10–400 (mgKOH/g), all organic compounds having acid value of 10–400 mgKOH/g) such as generally known organic fatty acid, high acid value resin, and the like may be used. However, since an extremely low molecular organic acid or acceptor has the possibility to significantly deteriorate dispersibility of the filler, the effect caused by reduction in residual potential often cannot be obtained at satisfying level. Accordingly, to reduce the residual potential of the photoconductor and improve the dispersibility of the filler, a low molecular polymer, a resin, a copolymer and the like, and mixtures thereof are preferably used. Such an organic compound preferably has a linear structure having less three-dimensional obstruction. In order to improve the dispersibility, it is important to impart affinity to both the filler and the binder resin, and a material with serious three-dimensional obstruction deteriorates the dispersibility by the deterioration of its affinity, causing many problems as described above.

As the organic compound having acid value of 10–400 (mgKOH/g), polycarboxylic acid is preferably used. As the polycarboxylic acid, all of organic compounds containing carboxylic acid such as polyester resin, acrylic resin, a copolymer using acrylic acid or methacrylic acid, styrene-acryl copolymer, etc. and derivatives thereof, which are compounds having a structure containing carboxylic acid in a polymer or copolymer, can be used. These materials can be used in combination of two or more, with effect. As necessary, these materials are mixed with an organic fatty acid, whereby the dispersibility of the filler and the effect of reducing residual potential often improves.

The added amount of the organic compound having acid value of 10–400 (mgKOH/g) is set to 0.01–50 wt %, preferably 0.1–20 wt % to the filler contained. More preferably, it is set to a necessary minimum quantity. When the amount added is larger than what is required, adverse effect such as image blurring often appears, and when the amount added is too small, the effect of reducing residual potential cannot be obtained enough. The preferable acid value of the organic compound is 10–400 mgKOH/g, and more preferably 30–200 mgKOH/g. When the acid value is higher than what is required, the resistance is excessively reduced to induce image blurring, and when the acid value is too low, the necessary amount to be added increases, effect of reducing residual potential could not be obtained. It is thus necessary to determine the acid value of the organic compound based on balance with amount added. The acid value of the organic compound does not directly affect the reduction of residual potential. This effect is greatly affected by the structure or molecular weight of the organic compound used, the dispersibility of the filler or the like.

For the purpose of reducing the surface energy of the photoconductor, it is desirable to add various additives to the protective layer to reduce the surface energy. The additives include, for example, silicone oil, fluorine resin, silicone-based resin, and the like. Among them, silicone oil is most suitably used.

The protective layer of the photoconductor is generally optically transparent, because the protective layer needs to transmit an image light. Accordingly, the material added to reduce the surface energy must be compatible with the material forming the protective layer. Of course, there is a case when such material is optically transparent when it is present as a fine particle smaller than the wavelength of the image light, but it is rather difficult to cover the whole visible light area. It is necessary to take the dispersion stability of the coating solution into consideration for the production, resulting in a complicated design. From such a point, a "dissolved" state (the state dissolved through a solvent) is preferable as the state of the coating solution. The silicone oil in the present invention is selected from such a viewpoint, and preferably used.

The outermost layer of the photoconductor is a protective layer laminated for the purpose of protecting the photosensitive layer. When the surface energy is reduced by adding the silicone oil to the protective layer, the purpose of the present invention is more effectively accomplished. Considering the purpose of the present invention, such effect should be obtained over a long period of time. Considering this point, the silicone oil is often insufficient from a quantitative point in the state compatible with the material constituting the protective layer as described above. In such a case, the continuity of the effect can be improved by adding a quantity exceeding the limit of compatibility. The silicone oil is naturally precipitated in the layer. The silicone oil is generally precipitated in the inner portion of the protective layer [not only in the protective layer, but also in the photosensitive layer formed on the inside thereof (the side closer to the support)] and consequently laid in the state stocked within the photoconductor (breezed out to the surface as necessary).

Although the protective layer is apparently clouded white in this case, and the image light seems not to advance to the photoconductor inner portion, the degree of scattering of the image light has wavelength dependency, so that the closer the image light shifts to the longer wave side, the more image light advances. Actually, the image light is transmitted nearly 100% in a LD region (red to near infrared), and hardly causes any trouble also in a visible range (blue-red). The degree of scattering is remarkable in an ultraviolet portion having short wavelength. However, the light of this region is not used much as the image light in a general electrophotographic process, and frequently cut because it is harmful to the photoconductor, and this is out of the question.

The particle or droplet size (or diameter) of the silicone oil precipitated in the protective layer is one factor affecting image characteristics. As a result of examinations on the present invention, it is found that a diameter 1 μm or less does not affect a general image. A size larger than this often affect portion of the image. This is assumed to be attributed to that the optical carrier formed within the photoconductor cannot cross over the silicone oil portion having no carrier transportability. Although even about 1 μm might affect when observed from an extremely micro viewpoint, it is assumed that the influence caused by about 1 μm cannot be observed from the points of the particle diameter of toner used in the general electrophotographic process, the reproducibility in development and transfer, and the like. The size of the particle or droplet is related also to the thickness of the protective layer. As a result of examination, it was found that a size smaller than ⅕ of the thickness has no affect on the image. The reason for this is assumed to be caused by that the size of this degree do not obstruct the surface-directional (surface of photoconductor or support surface) progress of the optical carrier in addition to the above-mentioned reason.

In addition to the protective layer, the silicone oil may be added to a layer (photosensitive layer) closer to the support than it. When it is added in a quantity exceeding the compatibility, the internally accumulated form is often more advantageous, it is desirable to select effective means by confirmed in experiment. In this case, also, the silicone oil is often breezed to the protective layer reversely to the above, but this is not a particular problem. As described above, it is also breezed out to the protective layer side in repeated uses.

As the silicone oil used in the present invention, known silicone oils, for example, dimethyl silicone oil, methylphenyl silicone oil, methyl hydrogen polysiloxane, cyclic dimethyl polysiloxane, alkyl-modified silicone oil, polyether-modified silicone oil, alcohol-modified silicone oil, fluorine-modified silicone oil, amino-modified silicone oil, mercapto-modified silicone oil, epoxy-modified silicone oil, carboxyl-modified silicone oil, higher fatty acid-modified silicone oil, higher fatty acid-containing silicone oil and the like may be used, and any one capable of reducing the surface energy of the outermost layer may also be used. Among them, methylphenyl silicone oil can be particularly effectively used.

To form the protective layer, a general application method may be adapted. The appropriate thickness of the protective layer is about 0.1–10 μm.

In the photoconductor of the present invention, an intermediate layer (not shown in the drawings) may be provided in between the photosensitive layer and the protective layer. For the intermediate layer, a binder resin is generally used as the main component. The binder resins include polyamide, alcohol soluble nylon, water-soluble polyvinyl butyral, polyvinyl alcohol and the like. To form the intermediate layer, a general application method may be adapted as described above. The appropriate thickness of the intermediate layer is about 0.05–2 μm.

In the present invention, in order to improve the environmental resistance, particularly, to prevent the reduction in sensitivity and the rise of residual potential, an antioxidant, a plasticizer, a lubricant, an ultraviolet absorber, a low molecular charge transporting material, and a leveling agent may be added to each layer. Typical materials for these compounds are described below.

The antioxidants which may be added to each layer include those described below, but not limited to these.

(a) Phenolic Compounds 2,6-Di-t-butyl-p-cresol, butylated hydroxyanisole, 2,6-di-t-butyl-4-ethylphenol, n-octadecyl-3-(4'-hydroxy-3',5'-di-ti-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butyl phenol), 1,1,3-tris-(2-methyl-4-hydroxy-5-t-buthylphenyl)butane, 1,3,5-trimethyl-2,4,6-tris(3,5-di-ti-buthylphenyl)butane, 1,3,5-trimethyl-2,4,6-tris(3,5-di-t-butyl-4-hydroxybenzyl)benzene, tetraquis-[methylene-3-(3',5'-di-t-butyl-4'-hydroxyphenyl)propionate]methane, bis[3,3'-bis(4'-hydroxy-3'-t-butylphenyl)butyric acid]glycol ester, tocopherol, and the like.

(b) Paraphenylenediamines

N-Phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, and the like.

(c) Hydroquinones 2,5-Di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone, and the like.

(d) Organic Sulfur Compounds

Dilauryl-3,3'-thiodipropionate, distearyl-3,3'-thiodipropionate, ditefradecyl-3,3'-thiodipropionate, and the like (e),Organic Phosphor Compounds Triphenyl phosphine, tri(nonylphenyl)phosphine, tri(dinonylphenyl)phosphine, tricresyl phosphine, tri(2,4-dibutylphenoxy)phosphine and the like.

The plasticizers which may be added to each layer include those described below, bur are not limited to these.

(a) Phosphate-Based Plasticizers

Triphenyl phosphate, tricresyl phosphate, trioctyl phosphate, octyldiphenyl phosphate, trichloroethyl phosphate, cresylphenyl phosphate, tributyl phosphate, tri-2-ethylhexylphosphate, triphenyl phosphate, and the like.

(b) Phthalate-Based Plasticizers

Dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonyl phthalate, diisononyl phthalate, diisodecyl phthalate, diundecyl phthalate, tridecyl phthalate, dicyclohexyl phthalate, butylbenzyl phthalate, butyl lauryl phthalate, methyloleyl phthalate, octyldecyl phthalate, dibutyl fumarate, dioctyl fumarate, and the like.

(c) Aromatic Carboxylate-Based Plasticizers

Trioctyl trimeritate, tri-n-octyl trimeritate, octyl oxybenzoate, and the like.

(d) Aliphatic Dibasic Acid Ester-Based Plasticizers

Dibutyl adipate, di-n-hexyl adipate, di-w-ethylhexyl adipate, di-n-octyl adipate, n-octyl-n-decyl adipate, diisodecyl adipate, dicapryl adipate, di-2-ethylhexyl azelate, dimethyl sebacate, diethyl sebacate, dibutyl sebacate, di-n-octyl sebacate, di-2-ethylhexyl sebacate, di-2-ethoxyetyl sebacate, dioctyl succinate, diisodecyl succinate, dioctyl tetrahydrophthalate, di-n-octyl tetrahydrophthalate, and the like.

(e) Fatty Acid Ester Derivatives

Butyl oleate, glycerin monooleate, methyl acetyl ricinoleate, pentaerythritol ester, dipentaerythritol hexa ester, triacetine, tributyrine, and the like.

(f) Oxy Acid Ester-Based Plasticizers

Methyl acetyl ricinoleate, butyl acetyl ricinoleate, butylphthalyl butyl glycolate, tributyl acetyl citrate, and the like.

(g) Epoxy Plasticizers

Epoxidized soybean oil, epoxidized linseed oil, butyl epoxy stearate, decyl epoxy stearate, octyl epoxy stearate, benzyl epoxy stearate, diocyl epoxy hexahydrophthalate, decyl epoxy hexahydrophthalate, and the like.

(h) Dihydric Alcohol Ester-Based Plasticizers

Diethylene glycol dibenzoate, triethylene glycol di-2-ethylbutylate, and the like.

(i) Chlorinated Plasticizers

Chlorinated paraffin, chlorinated diphenyl, chlorinated fatty acid methyl, methoxy chlorinated fatty acid methyl, and the like.

(j) Polyester-Based Plasticizers

Polypropylene adipate, polypropylene sebacate, polyester, acetylated polyester, and the like.

(k) Sulfonic Acid Derivatives p-Toluene sulfonamide, o-toluene sulfonamide, p-toluene sulfonethylamide, o-toluene sulfonethylamide, toluene sulfone-N-ethylamide, p-toluenesulfone-N-cyclohexylamide, and the like.

(1) Citric Acid Derivatives

Triethyl citrate, triethyl acetyl citrate, tributyl citrate, tributyl acetyl citrate, tri-2-ethylhexyl acetyl citrate, n-octyl acetyl citrate, and the like.

(m) Others

Tertiary phenyl, partially hydrogenated tertiary phenyl, camphor, 2-nitrodiphenyl, dinonylnaphthalene, methyl abietate, and the like.

The lubricants which may be added to each layer include, for example, those described below, bur are not limited to these.

(a) Hydrocarbon-Based Compounds

Liquid paraffin, paraffin wax, microwax, low polymerized polyethylene, and the like.

(b) Fatty Acid-Based Compounds

Lauric acid, myristic acid, palmitic acid, stearic acid, alachidic acid, behenic acid, and the like.

(c) Fatty Amide-Based Compounds

Stearylamide, palmitylamide, oleinamide, methylene bisstealoamide, ethylene bissteraloamide, and the like.

(d) Ester-Based Compounds

Lower alcohol ester of fatty acid, polyhydric alcohol ester of fatty acid, fatty acid polyglycol ester, and the like.

(e) Alcohol-Based Compounds

Cetyl alcohol, stearyl alcohol, ethylene glycol, polyethylene glycol, polyglycerol, and the like.

(f) Metal Soap

Lead stearate, cadmium stearate, barium stearate, calcium stearate, zinc stearate, magnesium stearate, and the like.

(g) Natural Wax

Carnauba wax, candelilla wax, beeswax, permaceti wax, Chinese wax, montan wax, and the like.

(h) Others

Silicone compound, fluorine compound, and the like.

The ultraviolet absorbers which may be added to each layer includes, for example, those described below, but not limited to these.

(a) Benzophenone-Based Ones

2-Hydroxybenzophenone, 2,4-dihydroxybenzophenone, 2,2',4-trihydroxybenzophenone, 2,2',4,4'-tetrahydroxybenzophonone, 2,2'-dihydroxy-4-methoxybenzophenone, and the like.

(b) Salicylate-Based Ones

Phenyl salicylate, 2,4-di-t-butylphenyl-3,5-di-t-butyl-4-hydroxybenzoate, and the like.

(c) Benzotriazol-Based Ones (2'-Hydroxyphenyl)benzotriazol, (2'-hydroxy-5'-methylphenyl)benzotriazol, (2'-hydroxy5'-methylphenyl) benzotriazol, (2'-hydrox-3'-tertiarybutyl-5'-methylphenyl)-5-chlorobenzotriazol, and the like.

(d) Cyano Acrylate-Based One

Ethyl-2-cyano-3,3'-diphenylacrylate, methyl-2-carbomethoxy-3-(paramethoxy)acrylate, and the like.

(e) Quencher (Metal Complex Salt-Based)

Nickel{2,2'-thiobis(4-t-octyl)phenolate}normal butylamine, nickel dibutyl dithiocarbamate, nickel dibutyl dithiocarbamate, cobalt dicyclohexyl dithiophosphate, and the like.

(f) HALS (Hindered Amine)

Bis(2,2,6,6-tetramethyl-4-piperidyl)sebacate, bis(1,2,2,6,6-pentamethyl-4-piperidyl)sebacate, 1-[2-{3-(3,5-di-butyl-4-hydroxhphenyl)propionyloxy}ethyl]-4-{3-(3,5-di-ti-butyl-4-hydroxyphenyl)propionyloxy}ethyl]-2,2,6,6-tetramethylpyridine, 8-benzyl-7,7,9,9-tetramethyl-3-octyl-1,3,8-triazaspiro[4,5]und ecane-2,4-dione, 4-benzoiloxy-2,2,6,6-tetramethylpiperidine, and the like.

The electrophotographic device of the present invention is then described in detail using the drawings.

Figure 4:
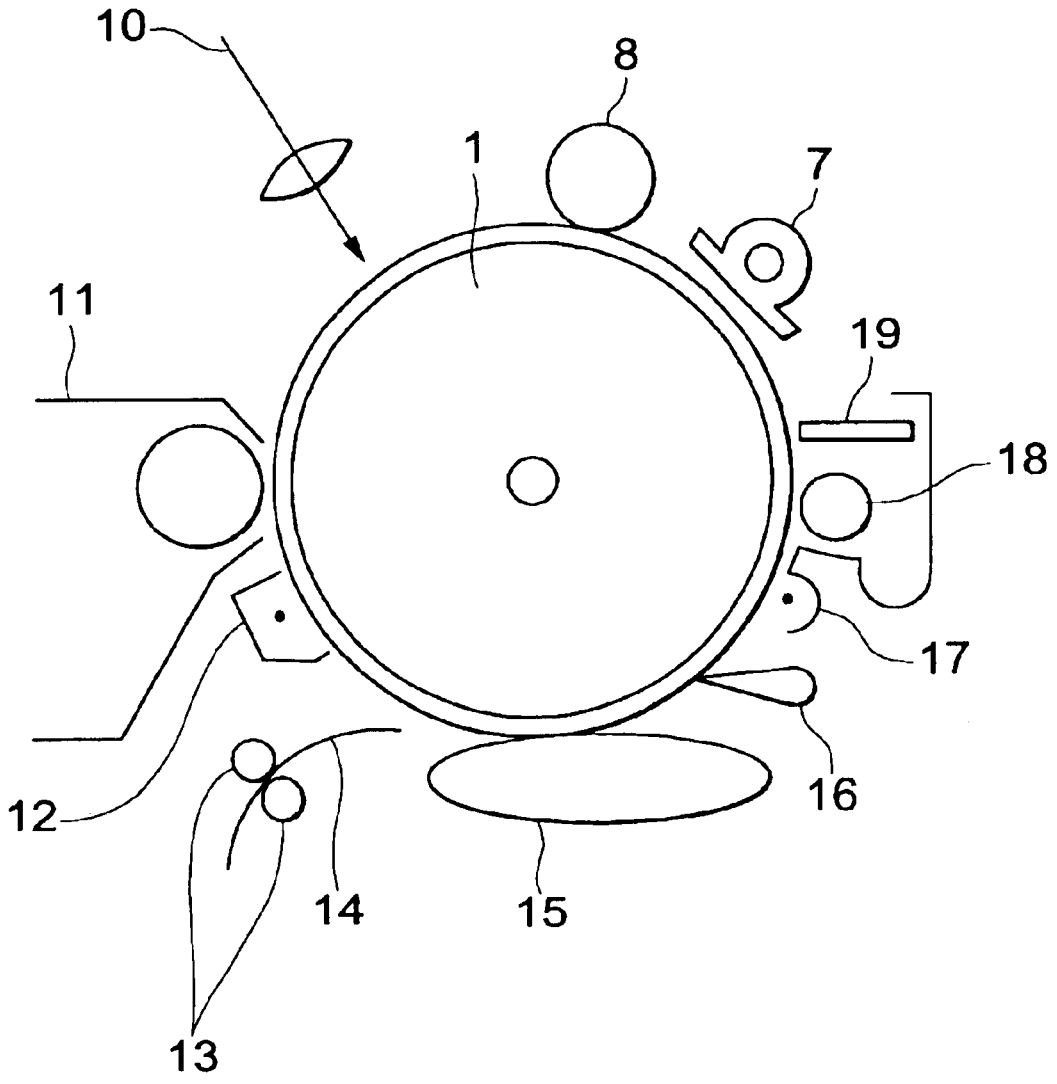
FIG. 4 is a schematic view for describing an electrophotographic device according to the present invention.

FIG. 4 is a schematic view showing one example of an electrophotographic device according to the present invention, and a modified example as described below also belongs to the category of the present invention.

In FIG. 4, a photoconductor 1 comprises a photosensitive layer and a protective layer (outermost layer) containing a filler provided on a conductive support. The photoconductor 1 has a drum shape, but it may have a sheet-like or endless belt-like shape.

An charging member 8 is arranged in contact with or adjacently to the photoconductor. The charging member is preferably used with less generation of ozone or nitrogen oxide forming the generation source of a low resistance material, compared with the corona charging by a charger represented by a corotron or scorotron. Particularly, a non-contact charge roller having the charging member adjacently arranged to the surface of photoconductor in 200 μm or less (preferably, 100 μm or less) is preferably usable with extremely little contamination of the charging member in repeated uses.

Figure 5:
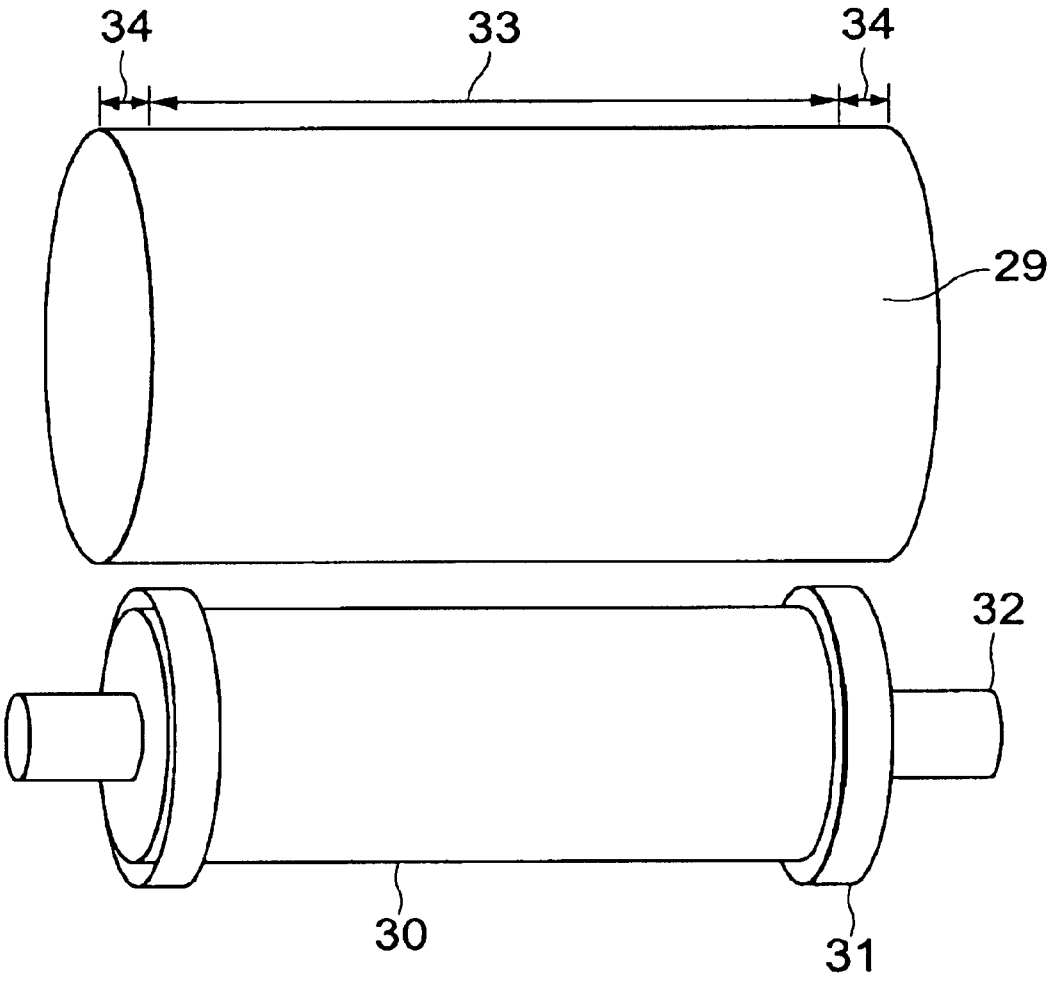
FIG. 5 is a schematic view showing a non-contact charging mechanism (comprising a gap retaining mechanism formed on an charging member side).

The adjacently arranged charging member is of a type adjacently arranged in a non-contact state so as to have a gap of 200 μm or less between the surface of photoconductor and the charging member surface. It is discriminated from known chargers represented by corotron and scorotron by the distance of gap. The adjacently arranged charging member of the present invention may have any shape if it has a mechanism capable of appropriately controlling the gap with the surface of photoconductor. For example, the rotating shaft of the photoconductor can be mechanically fixed to the rotating shaft of the charging member and arranged so as to have a appropriate gap. Particularly, the gap can be stably kept with an easy method by using an charge roller-shaped charging member, arranging gap-forming members on both ends of the non-image forming portion of the charging member, and allowing only these parts to abut on the surface of photoconductor to arrange an image forming area in no contact; or by arranging the gap-forming members on both ends of the non-image forming portion of the photoconductor and allowing only these portions to abut on the charging member surface to arrange the image forming area in no contact. Particularly, the methods described in Japanese Patent Application Nos. 13-211448 and 13-226432 may suitably be used. One example of an adjacent charging mechanism having the gap-forming members arranged on the charging member side is shown in FIG. 5. In FIG. 5, denoted at 29 is a photoconductor, 30 is a charging roller, 31 is a gap-forming member, 32 is a metal shaft, 33 is an image forming area, and 34 is a non-image forming area.

A pre-transfer charger 12, a transfer charger, a separation charger, and a pre-cleaning charger 17 are arranged as necessary, and known means including a corotron, a scorotron, a solid state charger and an charge roller may be used. In charging the photoconductor by the charging member, the photoconductor is charged by the electric field having an AC component superimposed on a DC component in the charging member, whereby the uneven charge can be effectively reduced (FIG. 4).

Figure 6:
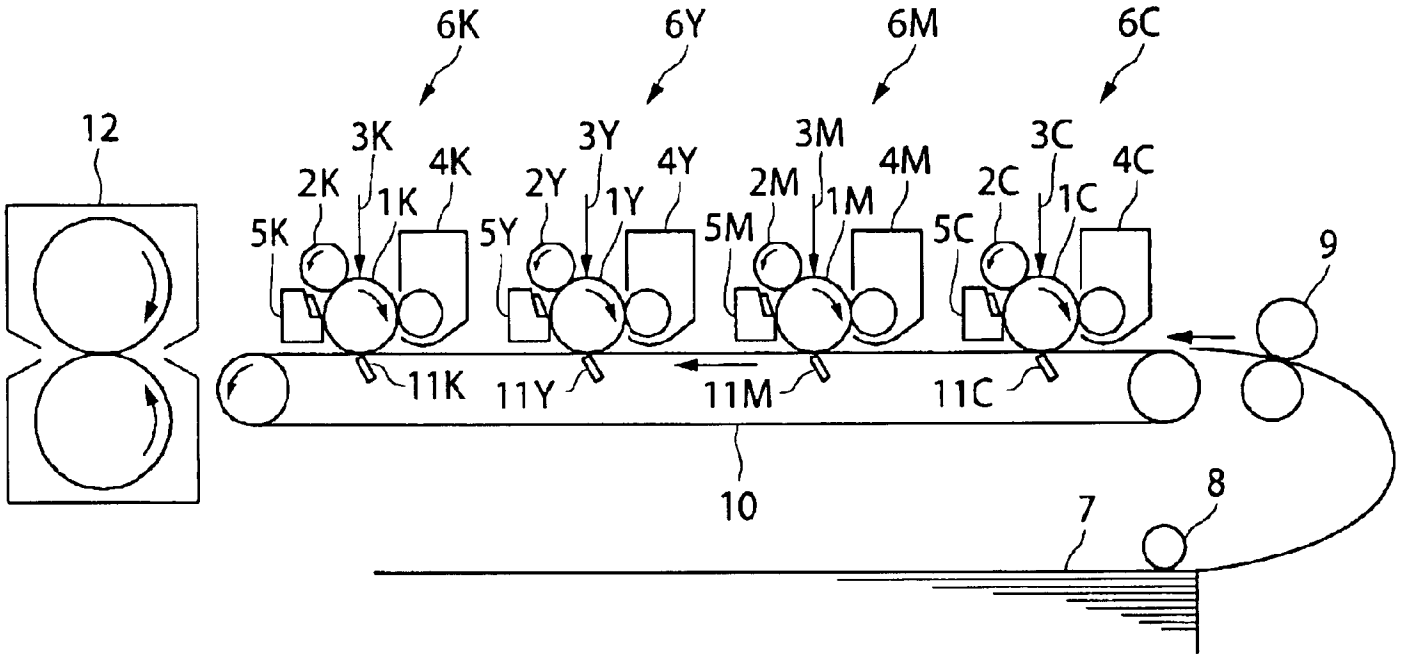
FIG. 6 is a schematic view showing another electrophotographic device according to the present invention.

FIG. 6 is a schematic view for illustrating another electrophotographic device according to the present invention, and a modified example as described below also belongs to the category of the present invention.

In FIG. 6, denoted at 1C, 1M, 1Y and 1K are drum-like photoconductors, and the photoconductors 1C, 1M, 1Y and 1K are rotated in the direction shown by the arrow in the drawing. At least charging members 2C, 2M, 2Y and 2K, developing members 4C, 4M, 4Y and 4K, and cleaning members 5C, 5M, 5Y and 5K are arranged around them, respectively. The charging members 2C, 2M, 2Y and 2K constitute an charging device for uniformly charging the surface of photoconductor. Laser beams 3C, 3M, 3Y and 3K from exposing members not shown in the drawings between the charging members 2C, 2M, 2Y and 2K and the developing members 4C, 4M, 4Y and 4K are emitted to the surface of photoconductors to form electrostatic latent images on the photoconductors 1C, 1M, 1Y and 1K. Four image forming elements (units) 6C, 6M, 6Y and 6K having the photoconductors 1C, 1M, 1Y and 1K as cores are juxtaposed along a transfer carrying belt 10 that is a transfer material carrying means. The transfer carrying belt 10 abuts on the photoconductors 1C, 1M, 1Y and 1K between the developing members 4C, 4M, 4Y and 4K and the cleaning members 5C, 5M, 5Y and 5K of each image forming unit 6C, 6M, 6Y and 6K, respectively, and transfer brushes 11C, 11M, 11Y and 11K for applying a transfer bias are arranged on the side (reverse side) corresponding to the photoconductor-side back of the transfer carrying belt 10. Each image forming element 6C, 6M, 6Y or 6K has the same structure except that the color of toner in the developing device is differed, and the black toner image forming photoconductor 1K related to the present invention is differed in crude pipe diameter from other photoconductors (the circumference of the photoconductor 1K is longer than those of the photoconductors 1C, 1M, and 1Y).

In the color electrophotographic device having the structure shown in FIG. 6, an image forming operation is performed as follows. In each image forming element 6C, 6M, 6Y or 6K, each photoconductor 1C, 1M, 1Y or 1K is charged by the charging member 2C, 2M, 2Y or 2K rotating in the direction shown by the arrow (the co-rotating direction with the photoconductor), and an electrostatic latent image corresponding to the image of each color to be formed is formed by laser beam 3C, 3M, 3Y or 3K in an exposing portion. The latent image is developed by each developing member 4C, 4M, 4Y or 4K to form a toner image. The developing members 4C, 4M, 4Y and 4K perform development with toners of C (cyan), M (magenta), Y (yellow) and K (black), respectively, and the toner images of each color formed on the four photoconductors 1C, 1M, 1Y and 1K are overlapped on a transfer paper. The transfer paper 7 is fed from a tray by a feed roll 8, once stopped in a pair of resist rollers 9, and then sent to the transfer carrying belt 10 at a timing matched to the image formation onto the photoconductor. The transfer paper 7 held on the transfer carrying belt 10 is carried, and the transfer of each color toner image is preformed in a contact position (transfer portion) with each photoconductor 1C, 1M, 1Y and 1K. The toner image on the photoconductor is transferred onto the transfer paper 7 by the electric field created by the potential difference between the transfer bias applied to the transfer brushes 11C, 11M, 11Y and 11K and the photoconductors 1C, 1M, 1Y and 1K. The recording paper 7 having the four color toner images overlapped thereon through the four transfer portions is carried to a fixing device 12 to fix the toner, and then discharged to a discharge portion not shown in the drawings. The residual toner left on each photoconductor 1C, 1M, 1Y or 1K without being transferred in the transfer portion is recovered by cleaning devices 5C, 5M, 5Y and 5K. In the example of FIG. 6, the image forming elements are arranged in the order of C (cyan), M (magenta), Y (yellow) and K (black) from the transfer carrying directional upstream side to the downstream side, but the order of colors may be optionally set without being limited to this order. In the formation of a document of only black, it particularly effective for the present invention to provide a mechanism for stopping the image forming elements 6C, 6M and 6Y other than the black.

A member for supplying zinc stearate onto the surface of photoconductor, which is not shown in the drawings, may be further provided. The supply of the zinc stearate onto the surface of photoconductor allows the filming suppression in a state with satisfactory wear resistance, and further effective to suppress the image flowing or ununiformity of halftone while retaining the wear resistance, in the electrophotographic process equipped with the photoconductor, by repeating the toner adhesion and the toner recovering operation in the cleaning portion at the non-image forming time. To supply the zinc stearate, it is an extremely effective means to include the zinc stearate in the developer (toner) present in the developing portion.

When the quantity of the zinc stearate supplied onto the photoconductor is too large, the output quantity onto the transfer output image is increased to unpreferably cause a fixing failure. When the friction coefficient of the surface of photoconductor lowers to about 0.1 by the excessive supply of zinc stearate, a reduction in image density is unpreferably caused. For example, when the zinc stearate is supplied to the surface of photoconductor in the state included in the toner, the content in the toner is preferably set to 0.1–0.2 wt %.

In the step for forming an image according to the present invention, the suppression of the filming on the surface of photoconductor and the suppression of the adhesion or accumulation of a product by charging while retaining the wear resistance can be attained by the toner adhesion to the photoconductor and the toner recovering operation in the cleaning portion at the time of non-image forming. This is assumed to be attributed to that it has a cleaning effect for discharging various deposits on the photoconductor together with the toner. For the toner adhesion and recovering operation, a toner adhesion quantity of about halftone and an operating time of about 30 second (in photoconductor diameter 30 mm, linear speed 125 mm/s) are effective, and the adhesion quantity and operating time exceeding them are not preferable because the load to the cleaning portion and the toner consumption are increased. When the photoconductor diameter and linear velocity are varied, the adhesion quantity and operating time may be appropriately adjusted so as to have the same operating condition as the above.

The above-mentioned chargers are usable as the transfer means, and a one using a transfer belt as shown in FIG. 4 may suitably be used.

As light sources of an image exposure part 10, a charge removing lamp 7 and the like shown in FIG. 4, light emittion source such as fluorescent lamp, tungsten lamp, halogen lamp, mercury vapor lamp, low pressure sodium lamp, light emitting diode (LED), semiconductor laser (LD), electroluminescence (EL), and the like are generally used. In order to emit a light of desired wavelength, various filters such as sharp cut filter, band pass filter, near infrared cut filter, dichroic filer, interference filter, color temperature conversion filter and the like may also be used.

Such light sources are provided in the step for transferring, charge removing process, cleaning process, or pre-exposure process jointly using photoirradiation in addition to the process shown in FIG. 4, whereby light is applied to the photoconductor.

The toner developed on the photoconductor 1 by a developing unit 11 shown in FIG. 4 is transferred to a transfer paper 14. This toner is not entirely transferred thereto but partially left on the photoconductor 1. Such a residual toner is removed from the photoconductor with a cleaning blade 18. The cleaning is often performed using only the cleaning blade, but a cleaning brush or the like may often be used. As the cleaning brush, known brushes including fur brush, magnetic fur brush and the like may be used.

In FIG. 4, numeral 13 indicates a resist roller, 15 a transfer belt, 16 a separation claw, and 18 a fur brush.

When a photoelectric photoconductor is positively (negatively) charged in an image exposure, a positive (negative) electrostatic latent image is formed on the surface of photoconductor.

This is developed with a toner of negative (positive) polarity (detecting fine particle), whereby a positive image is formed, and developed with a toner of positive (negative) polarity, whereby a negative image is formed.

A known method may be applied to such developing means, and a known method may be used for charge removing means.

EXAMPLES

The present invention is more specifically described according to preparation examples and working examples, however the present invention is not limited thereto. All numerals in the following formulations denote parts by weight.

Synthetic Example of Polyester Resin

Synthetic Example 1

To a four-neck separable flask equipped with a stirrer, a thermometer, a nitrogen inlet port, a falling capacitor and a cooling pipe were added 740 g of polyoxypropylene(2,2)-2,2-bis(4-hydroxyphenyl)propane, 300 g of polyoxyethylene(2,2)-2,2-bis(4-hydroxyphenyl)propane, 466 g of dimethyl terephthalate, 80 g of isodecenyl succinic anhydride, and 114 g of tri-n-butyl 1,2,4-benzenetricarboxylate together with an esterification catalyst. These were reacted while raising the temperature to 210° C. at ordinary pressure under nitrogen atmosphere in the first half and while reducing the pressure at 210° C. with stirring in the latter half. A polyester resin with acid value of 2.3 KOHmg/g, hydroxyl value of 28.0 KOHmg/g, softening point of 106° C., and Tg of 62° C. was consequently obtained (hereinafter referred to as polyester resin A).

Synthetic Example 2

725 g of polyoxypropylene(2,2)-2,2-bis(4-hydroxyphenyl)propane, 165 g of polyoxyethylene(2,2)-2,2-bis(4-hydroxyphenyl)-propane, 500 g of terephthalic acid, 130 g of isodecenyl succinic anhydride, and 170 g of triisopropyl 1,2,4-benenetricarboxylate together with an esterification catalyst were added in the flask. These were reacted with the same device and the same method as in Synthetic Example 1, and a polyester resin with acid value of 0.5 KOHmg/g, hydroxyl value of 25.0 KOHmg/g, softening point of 109° C., and Tg of 63° C. was obtained (hereinafter referred to as polyester resin B).

Synthetic Example of Polyol Resin

Synthetic Example 1

To a separable flask equipped with a stirrer, a thermometer, a nitrogen inlet port, and a cooling pipe were added 378.4 g of low molecular bisphenol A type epoxy resin (number average molecular weight: about 360), 86.0 g of high molecular bisphenol A type epoxy resin (number average molecular weight: about 2700), 191.0 g of glycidylate of bisphenol A type propylene oxide additive, 274.5 g of bisphenol F, 70.1 g of p-cumyl phenol, and 200 g of xylene. The temperature was raised to 70–100° C. under nitrogen atmosphere to add 0.1839 g of lithium chloride, and then further raised to 160° C. to remove the xylene under reduced pressure. The resulting mixture was polymerized at a reaction temperature of 180° C. for 6–9 hrs to obtain a polyol resin with acid value of 0.0 KOHmg/g, hydroxyl value of 70.0 KOHmg/g, softening point of 109° C., and Tg of 58° C. (hereinafter referred to as polyol resin A).

Synthetic Example 2

Using the device of Synthetic Example 1, 205.3 g of low molecular bisphenol A type epoxy resin (number average molecular weight: about 360), 54.0 g of high molecular bisphenol A type epoxy resin (number average molecular weight: about 3000), 432.0 g of glycidylate of bisphenol A type propylene oxide additive, 282.7 g of bisphenol F, 26.0 g of p-cumyl phenol, and 200 g of xylene were added thereto. The temperature was raised to 70–100° C. under nitrogen atmosphere to add 0.183 g of lithium chloride, and further raised to 160° C. to remove the xylene under reduced pressure. The resulting mixture was polymerized at a reaction temperature of 180° C. for 6–9 hrs to obtain a polyol resin with acid value 0.0 of KOHmg/g, hydroxyl value of 58.0 KOHmg/g, softening point of 109° C., and Tg of 58° C. (hereinafter referred to as polyol resin B).

Preparation Example of Parent Toner 1

| | | |
|---|---|---|
| Binder resin | Polyester resin A | 100 parts |
| Coloring agent | Quinacridone-based magenta pigment | 4 parts |
| Charge controlling agent | Zinc compound of salicylic acid | 4 parts |

1. The above starting materials were mixed by a Henschel mixer;

2. melted and kneaded using a bus cokneader (made by BUS) set to 120° C.;

3. the kneaded matter was finely pulverized using a pulverizing machine using a turbo mill (manufactured by TURBO KYOGYO) after cooling; and 4. classified using a wind classifier to obtain a magenta parent toner (a) having volume average particle diameter: 6.38 $\mu$m, and specific surface area: 2.48 $m^2/g$.

Preparation Example of Product Toner 1

To 100 parts of the parent toner (a) of Preparation Example of Parent Toner 1, 0.7 wt % of HDK 2000H (made by WACKER, BET specific surface area: 140 $m^2/g$) and 0.5 wt % of AEROSIL RX 50 (made by NIPPON AEROSIL, BET specific surface area: 50 $m^2/g$) as silica, and 0.5 wt % of MT 150 (made by TAYCA, BET specific surface area: 65 $m^2/g$) as titania were added, and sufficiently mixed using a Henschel mixer (made by MITSUI MIIKE) to obtain an electrophotographic toner A.

Preparation Example of Product Toner 2

To 100 parts of the parent toner (a) of Preparation Example of Parent Toner 1, 0.5 wt % of TG-810G (made by CABOT, BET specific surface area: 230 $m^2/g$) and 0.5 wt % of AEROSIL RX50 (made by NIPPON AEROSIL, BET specific surface area: 50 $m^2/g$) as silica, and 0.5 wt % of MT 250 (made by TAYCA, BET specific surface area; 65 $m^2/g$) as titania were added, and sufficiently mixed using a Henschel mixer (made by MITSUI MIIKE) to obtain an electrophotographic toner B.

Preparation Example of Product Toner 3

To 100 parts of the parent toner (a) of Preparation Example of Parent Toner 1, 0.5 wt % of AEROSIL RX200 (made by NIPPON AEROSIL, BET specific surface area: 200 $m^2/g$) and 1.2 wt % of AEROSIL RX50 (made by NIPPON AEROSIL, BET specific surface area: 50 $m^2/g$) as silica, and 0.5 wt % of MT 150 (made by TAYCA, BET specific surface area; 65 $m^2/g$) as titania were added, and sufficiently mixed using a Henschel mixer (made by MITSUI MIIKE) to obtain an electrophotographic toner C.

Preparation Example of Parent Toner 2

| | | |
|---|---|---|
| Binder resin | Polyester resin B | 100 parts |
| Coloring agent | Quinacridone-based magenta pigment | 4 parts |
| Charge controlling agent | Chromium compound of salicylic acid | 4 parts |

1. The above starting materials were mixed by a Henschel mixer;

2. melted and kneaded using a bus cokneader (made by BUS) set to 120° C.;

3. the kneaded matter was finely pulverized using a pulverizing machine using a turbo mill (manufactured by TURBO) after cooling; and 4. classified using a wind classifier to obtain a magenta parent toner (b) having volume average particle diameter: 6.69 $\mu$m, and specific surface area: 2.34 $m^2/g$.

Preparation Example of Product Toner 4

To 100 parts of the parent toner (b) of Preparation Example of Parent Toner 2, 0.7 wt % of HDK 2000H (made by WACKER, BET specific surface area: 140 $m^2/g$) and 0.5 wt % of AEROSIL RX50 (made by NIPPON AEROSIL, BET specific surface area: 50 $m^2/g$) as silica, and 0.5 wt % of MT 150 (made by TAYCA, BET specific surface area; 65 $m^2/g$) as titania were added, and sufficiently mixed using a Henschel mixer (made by MITSUI MIIKE) to obtain an electrophotographic toner D.

Preparation Example of Parent Toner 3

| | | |
|---|---|---|
| Binder resin | Polyol resin A | 100 parts |
| Coloring agent | Quinacridone-based magenta pigment | 4 parts |
| Charge controlling agent | Zinc compound of salicylic acid | 4 parts |

1. The above starting materials were mixed by a Henschel mixer;

2. melted and kneaded using a bus cokneader (manufactured by BUS) set to 120° C.;

3. the kneaded matter was finely pulverized using a pulverizing machine using a jet flow after cooling; and 4. classified using a wind classifier to obtain a magenta parent toner (c) having volume average particle diameter: 5.36 $\mu$m, and specific surface area: 4.12 $m^2/g$.

Preparation Example of Product Toner 5

To 100 parts of the parent toner (c) of Preparation Example of Parent Toner 3, 1.0 wt % of AEROSIL RX50 (made by NIPPON AEROSIL, BET specific surface area: 50 $m^2/g$) as silica, and 0.5 wt % of MT 150 (made by TAYCA, BET specific surface area; 65 $m^2/g$) as titania were added, and sufficiently mixed using a Henschel mixer (made by MITSUI MIIKE) to obtain an electrophotographic toner E.

Preparation Example of Product Toner 6

To 100 parts of the parent toner b of Preparation Example of Parent Toner 2, 1.0 wt % of TB-810G (made by CABOT, BET specific surface area: 230 $m^2/g$) and 1.8 wt % of AEROSIL RX50 (made by NIPPON AEROSIL, BET specific surface area: 50 $m^2/g$) as silica, and 0.5 wt % of MT 150 (made by TAYCA, BET specific surface area; 65 $m^2/g$) as titania were added, and sufficiently mixed using a Henschel mixer (made by MITSUI MIIKE) to obtain an electrophotographic toner F.

(Preparation of Photoconductor (a))

An undercoat layer coating solution, charge generating layer coating solution, and charge transporting layer coating solution having the following compositions were successively applied onto an aluminum cylinder (material: JIS 1050) 90 mm in diameter and 391. 7 mm in length followed by drying to form an electrophotographic photoconductor consisting of an undercoat layer of 3.5 $\mu$m, a charge generating layer of 0.2 $\mu$m, a charge transporting layer of 22 $\mu$m, and a protective layer of 2 $\mu$m.

<Undercoat layer coating solution>

| | |
|---|---|
| Titanium dioxide powder | 400 parts |
| Melamine resin | 65 parts |
| Alkyd resin | 120 parts |
| 2-Butanone | 400 parts |

<Charge generating layer coating solution>

Azobis pigment of the following structure 8 parts

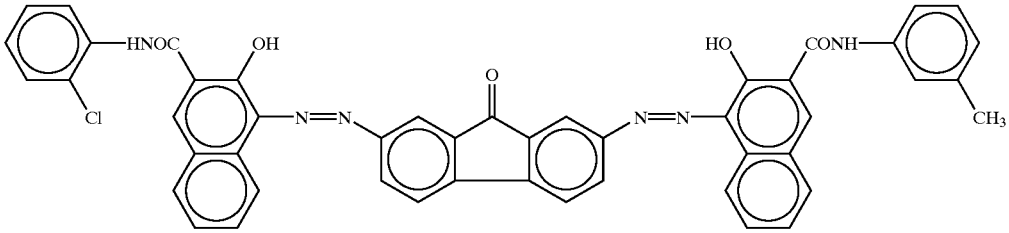

Trisazo pigment having the following structure 6 parts

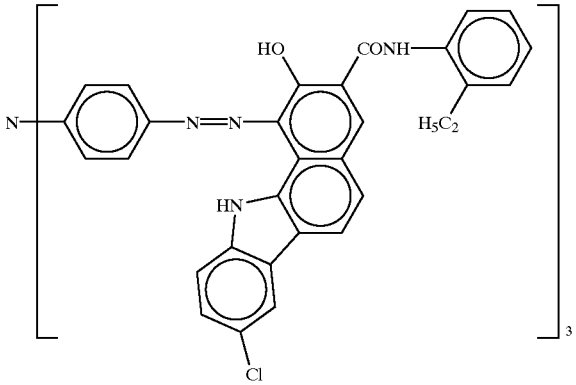

| | |
|---|---|
| Polyvinyl butyral | 5 parts |
| 2-Butanone | 200 parts |
| Cyclohexane | 400 parts |

<Charge transporting layer coating solution>

| | |
|---|---|
| A-type polycarbonate | 10 parts |
| Charge transporting material of the following structural formula | 7 parts |

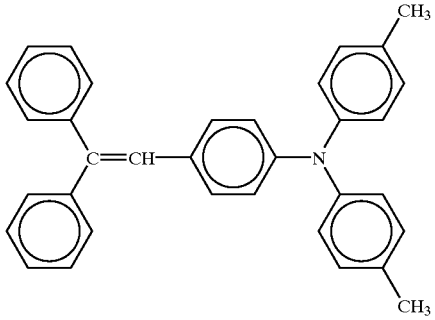

-continued

| | |
|---|---|
| Tetrahydrofurane | 400 parts |
| Cyclohexanone | 150 parts |
| <Protective layer coating solution> | |
| A-type polycarbonate | 10 parts |
| Charge transporting material of the following structural formula | 8 parts |

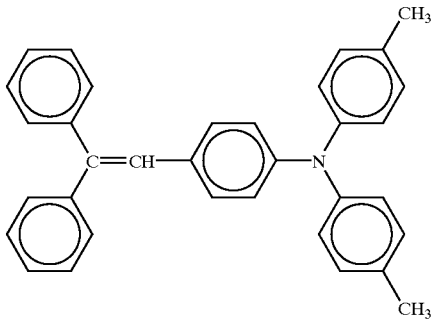

| | |
|---|---|
| Tetrafluoroethylene particle (Specific resistance: $1 \times 10^{15}\Omega \cdot$ cm, average primary particle diameter: 0.3 $\mu$m) | 4 parts |
| Tetrahydrofurane | 400 parts |
| Cyclohexanone | 150 parts |

(Preparation of Photoconductor (b))

A photoconductor (b) was obtained in the same manner as in the photoconductor (a) except using alumina fine particle instead of the tetrafluoroethylene particle of the protective layer coating solution material in the photoconductor (a).

(Preparation of Photoconductor (c))

A photoconductor (c) was obtained in the same manner as in the photoconductor (a) except changing the protective layer coating solution to the following one.

| <Protective layer coating solution> | |
|---|---|
| High molecular charge transporting material of the following structural formula | 18 parts |

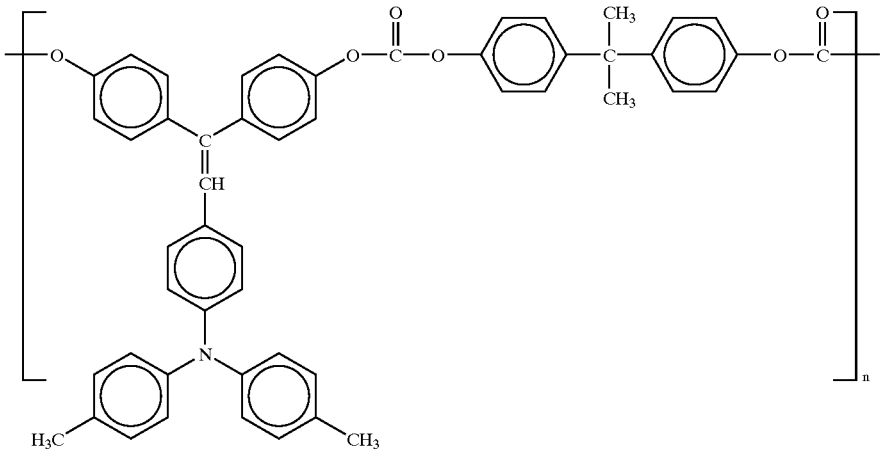

| | |
|---|---|
| Tetrafluoroethylene particle (Specific resistance: $1 \times 10^{15}\Omega \cdot$ cm, average primary particle diameter: 0.3 $\mu$m) | 4 parts |
| Tetrahydrofurane | 400 parts |
| Cyclohexanone | 150 parts |

(Preparation of Photoconductor (d))

A photoconductor (d) was obtained in the same manner as in the photoconductor (a) except not using the tetrafluoroethylene particle of the protective layer coating solution material in the photoconductor (a).

(Preparation of Photoconductor (e))

A photoconductor (e) was obtained in the same manner as in the photoconductor (a) except using no charge transporting material in the protective layer coating solution of the photoconductor (a).

(Preparation of Photoconductor (f))

A photoconductor (f) was obtained in the same manner as in photoconductor (a) except changing the protective layer coating solution to a one having the following composition.

| <Protective layer coating solution> | |
|---|---|
| A-type polycarbonate | 10 parts |
| Charge transporting material of the following structural formula | 8 parts |

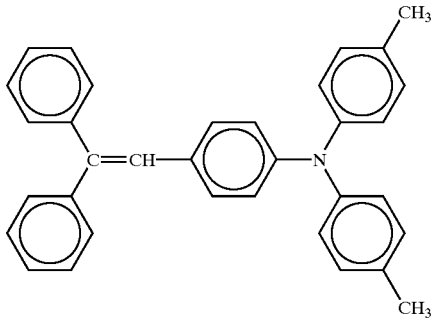

| | |
|---|---|
| Alumina fine particle (Specific resistance: 2.5 × $10^{12}\Omega \cdot$ cm, average primary particle diameter: 0.4 μm) | 4 parts |
| Unsaturated polycarboxylic polymer solution (Acid value: 180 mgKOH/g, made by BYK CHEMIE) | 0.1 parts |
| Tetrahydrofurane | 400 parts |
| Cyclohexanone | 150 parts |

(Preparation of Photoconductor (g))

A photoconductor (g) was obtained in the same manner as in the photoconductor (b) except changing the protective layer coating solution to a one having the following composition.

| <Protective layer coating solution> | |
|---|---|
| A-type polycarbonate | 10 parts |
| Charge transporting material of the following structural formula | 8 parts |

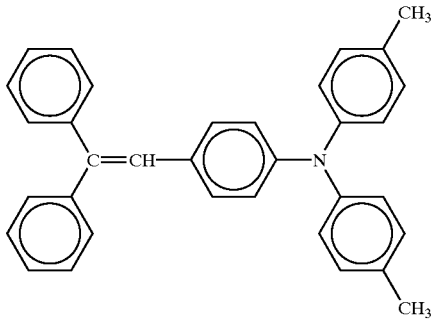

-continued

| <Protective layer coating solution> | |
|---|---|
| Alumina fine particle (Specific resistance: 2.5 × $10^{12}\Omega \cdot$ cm, average primary particle diameter: 0.4 μm) | 4 parts |
| Methylphenyl silicone oil (SINETSU SILICONE: KF 50) | 0.1 part |
| Tetrahydrofurane | 400 parts |
| Cyclohexanone | 150 parts |

(Preparation of Photoconductor (h))

A photoconductor (h) was prepared in the same manner as in the photoconductor (a) except changing the charge generating layer coating solution to a one having the following composition.

Figure 8:
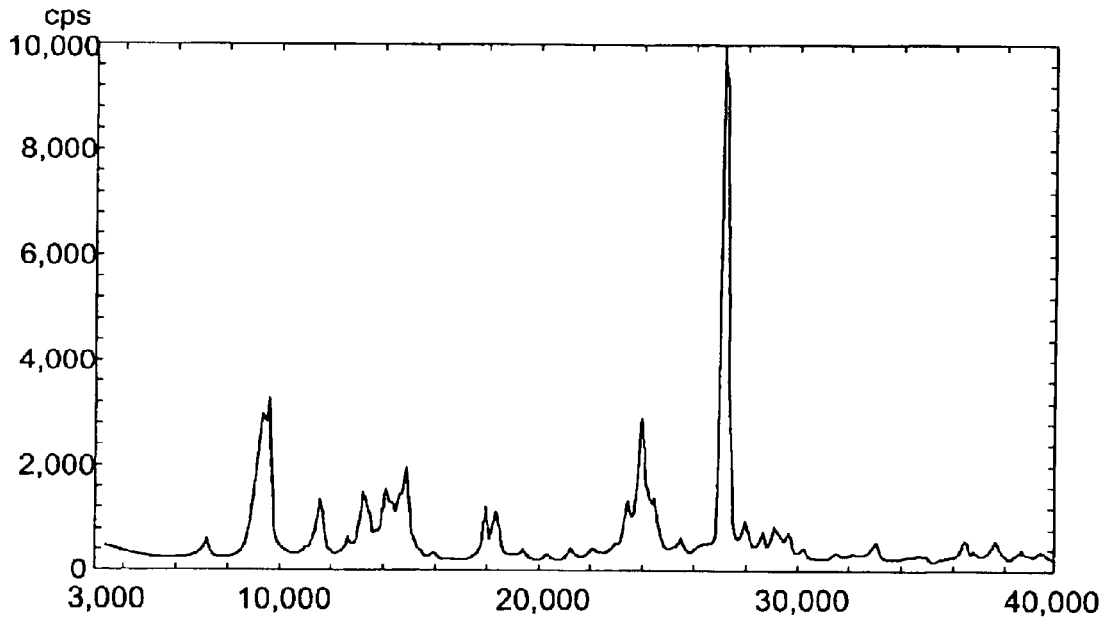
FIG. 8 is an XD spectral view of titanyl phthalocyanine contained in the charge generating layer of a photoconductor of Example 9 of the present invention.

| <Charge generating layer coating solution> | |
|---|---|
| Titanyl phthalocyanine having a spectrum shown in FIG. 8 | 3 parts |
| Polyvinyl butyral | 2 parts |
| 2-Butanone | 120 parts |

(Preparation of Photoconductor (i))

In the preparation example of the photoconductor (h), the conductive support was anodized as follows, and the charge generating layer, the charge transporting layer and the protective layer were provided in the same manner as the preparation example of the photoconductor (h) without providing any undercoat layer to obtain a photoconductor (i).

<Anodic Treatment>

The support surface was finished by mirror polishing followed by degreasing and washing with water, and then dipped in an electrolytic cell of temperature 20° C. and sulfuric acid 15 vol % to anodize it at an electrolytic voltage 15V for 30 min. After washing with water, a sealing treatment was performed using 7% nickel acetate aqueous solution (50° C.). Thereafter, a washing with pure water was performed to obtain a support having an anodic oxide film of 6 μm formed thereon.

Example 1

An actual use evaluation was carried out using the product toner A and the photoconductor (a).

Example 2

An actual use evaluation was carried out using the product toner B and the photoconductor (b).

Example 3

An actual use evaluation was carried out using the product toner C and the photoconductor (c).

Example 4

An actual use evaluation was carried out using the product toner D and the photoconductor (a).

Example 5

An actual use evaluation was carried out using the product toner B and the photoconductor (c).

Example 6

An actual use evaluation was carried out using the product toner A and the photoconductor (e).

Example 7

An actual use evaluation was carried out using the product toner A and the photoconductor (f).

Example 8

An actual use evaluation was carried out using the product toner A and the photoconductor (g).

Example 9

An actual use evaluation was carried out using the product toner A and the photoconductor (h).

Example 10

An actual use evaluation was carried out using the product toner A and the photoconductor (i).

Comparative Example 1

An actual use evaluation was carried out using the product toner E and the photoconductor (d).

Comparative Example 2

An actual use evaluation was carried out using the product toner E and the photoconductor (c).

Comparative Example 3

An actual use evaluation was carried out using the product toner F and the photoconductor (c).

[Actual Use Evaluation]

For the toners and photoconductors obtained in Examples and Comparative Examples, a copy test was carried out using a modified machine of "IPSIO Color 5000" made by RICHO to evaluate the following items. The modified machine was set to a state allowing the collection of eight A4 full-color copies per min by raising the processing speed of "Color 5000". The copy test was carried out in a 30,000-sheet full-color mode including black (working environment: 23° C., 55%RH). Just after starting the copy test and after 30,000-sheet copying, the filming to photoconductor and cleaning member, the scraping (wear) of photoconductor, and the image density of the resulting image were measured to evaluate the image quality.

The image density was measured using "X-rite 938" (made by X-RITE). The image quality was evaluated by visually observing whether density unevenness, resolution deterioration, or the like is present in the image or not.

[Physical Property Measurement]

Figure 7:
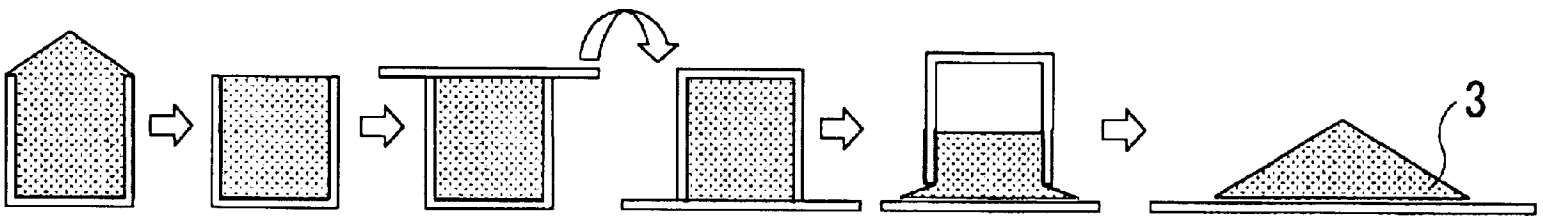
FIG. 7 is a flow chart showing an angle-of-repose measuring work in Examples of the present invention.

The angle of repose 3 was measured according to the above-mentioned method. The flowchart of the measuring work is shown in FIG. 7.

The physical properties of the toners used in Examples and Comparative Examples are shown in Table 1, and the angle of repose and roundness of each toner used and the image evaluation result are shown in Table 2.

TABLE 1

List of Toner Physical Properties

| | Volume Average Particle diameter (μm) | Specific Surface Area of Pulverized Colored Particle H ($m^2/g$) | Weight Content of Pulverized Colored Particle W (wt %) | Specific Surface Area of Additive 1 Ht1 ($m^2/g$) | Content of Additive 1 Wt1 (wt %) | Specific Surface Area of Additive 2 Ht2 ($m^2/g$) | Content of Additive 2 Wt2 (wt %) | Specific Surface Area of Additive 3 Ht3 ($m^2/g$) | Content of Additive 3 Wt3 (wt %) | Z |
|---|---|---|---|---|---|---|---|---|---|---|
| Product Toner A | 6.38 | 2.48 | 98.3 | 140 | 0.7 | 50 | 0.5 | 65 | 0.5 | 0.64 |
| Product Toner B | 6.38 | 2.48 | 98.5 | 230 | 0.5 | 50 | 0.5 | 65 | 0.5 | 0.71 |
| Product Toner C | 6.38 | 2.48 | 97.5 | 200 | 0.8 | 50 | 1.2 | 65 | 0.5 | 1.04 |
| Product Toner D | 6.69 | 2.34 | 98.3 | 140 | 0.7 | 50 | 0.5 | 65 | 0.5 | 0.68 |
| Product Toner E | 5.36 | 4.12 | 98.5 | 140 | 1.0 | — | — | 65 | 0.5 | 0.43 |
| Product Toner F | 6.69 | 2.34 | 96.7 | 230 | 1 | 50 | 1.8 | 65 | 0.5 | 1.56 |

TABLE 2

| | Toner | Photo conductor | Z | Angle of Repose (°) | Roundness | Filming to Cleaning Member | Filming to Photo-conductor | Scraped amount of Photoconductor (μm) | Image Density | Uneven Image Density | Resolution |
|---|---|---|---|---|---|---|---|---|---|---|---|
| Ex. 1 | A | a | 0.64 | 23 | 0.96 | ○ | ○ | 1.5 | 1.5 | ○ | ○ |
| Ex. 2 | B | b | 0.71 | 19 | 0.95 | ○ | ○ | 1.7 | 1.6 | ○ | ○ |
| Ex. 3 | C | c | 1.04 | 15 | 0.96 | ○ | ○ | 1.9 | 1.7 | ○ | ○ |
| Ex. 4 | D | a | 0.68 | 22 | 0.95 | ○ | ○ | 1.6 | 1.5 | ○ | ○ |
| Ex. 5 | B | c | 0.71 | 20 | 0.95 | ○ | ○ | 1.7 | 1.6 | ○ | ○ |
| Ex. 6 | A | e | 0.64 | 24 | 0.96 | ○ | ○ | 1.3 | 1.3 | ○ | ○ |
| Ex. 7 | A | f | 0.64 | 22 | 0.96 | ○ | ○ | 1.4 | 1.5 | ○ | ◎ |

TABLE 2-continued

| | Toner | Photo conductor | Z | Angle of Repose (°) | Roundness | Filming to Cleaning Member | Filming to Photo-conductor | Scraped amount of Photoconductor (μm) | Image Density | Uneven Image Density | Resolution |
|---|---|---|---|---|---|---|---|---|---|---|---|
| Ex. 8 | A | g | 0.64 | 16 | 0.96 | ○ | ◎ | 1.0 | 1.5 | ○ | ○ |
| Ex. 9 | A | h | 0.64 | 23 | 0.96 | ○ | ○ | 1.5 | 1.7 | ○ | ◎ |
| Ex. 10 | A | i | 0.64 | 23 | 0.96 | ○ | ○ | 1.5 | 1.7 | ◎ | ○ |
| Comp. Ex. 1 | E | d | 0.43 | 36 | 0.93 | X | X | 2.6 | 1.2 | X | X |
| Comp. Ex. 2 | E | c | 0.43 | 33 | 0.93 | X | X | 2.3 | 1.2 | X | X |
| Comp. Ex. 3 | F | c | 1.56 | 10 | 0.95 | X | X | 5.2 | 1.0 | X | Δ |

As is apparent from Table 2, the toners and photoconductors of Examples 1–10 of the present invention show satisfactory performances for the filming to photoconductor and cleaning member, the scraping of photoconductor, and the image density, uneven image desity and resolution of the resulting image in the 30,000-sheet copy test using the modified machine of "IPSIO Color 5000" made by RICHO, and have no problem from the point of maintenance property.

In Example 6 where no charge transporting material is added to the protective layer, the image density is slightly deteriorated, compared with Example 1, and it shows that the addition of the charge transporting material is effective. In the comparison of Example 7 with Example 1, the filler dispersing state of the protective layer was satisfactory in Example 7, and the resolution was consequently satisfactory. This shows that it is effective to include an organic compound with acid value of 10–400 (mgKOH/g) in the protectively layer. In the comparison of Example 8 with Example 1, the addition of a large quantity (a quantity as silicone oil is present as droplets) of silicone oil to the protective layer reduces the surface energy of the photoconductor, resulting in a reduction in the angle of repose, which apparently allows the prevention of the filming to photoconductor. The wear of the photoconductor was also minimized, which shows that such an addition is apparently contributable to the improvement of durability. In the comparison of Example 9 with Example 1, the recording light quantity could be rather reduced because the photoconductor of Example 9 was more sensitive. Consequently, the resolution could be improved. In the comparison of Example 10 with Example 1, the photoconductor of Example 10 was more stable in electrostatic property, and an image free from uneven image desity could be outputted.

For the toners and photoconductors of Comparative Examples 1–3, no particular problem arose in the initial stage, but the filming to photoconductor and cleaning member occurred after 30,000-sheet run, the scraped amount of photoconductor was increased, and the density reduction, uneven image desity and reduction in resolution of the resulting image also occurred.

Example 11

The charger of the copying machine used in Example 1 or a scorotron charger was changed and remodeled to a contact type charge roller, and a 30,000-sheet continuous copy was carried out in the same manner as in Example 1. The unexposed part potential of the photoconductor was adjusted so as to be the same as in Example 1 (−650V).

Example 12

The charger of the copying machine used in Example 11 or the contract type charge roller was changed and remodeled to the following charge roller, and a 30,000-sheet continuous copy was carried out in the same manner as in Example 11. The applied voltage was set to only the DC component similarly to Example 11.

<Charge roller>

A Teflon tape 80 μm thick was wound on both ends 5 mm (these areas are non-image forming portions) of the charge roller of Example 11 to form an adjacent arrangement charge roller as shown in FIG. 5.

Example 13

The continuous copy was carried out except changing the charge condition of Example 12 as follows.

<Charging Condition>

Unexposed part potential −650 V

As an AC component, −1.2 kV was applied by peak-to-peak.

After the 30,000-continuous runs of Examples 1 and 11–13, a halftone image was outputted under high temperature and high humidity (30° C., 90%RH) and evaluated for image quality. The result is shown in Table 3.

TABLE 3

| | Halftone Image | Note |
|---|---|---|
| Example 1 | Slight reduction in resolution | Strong ozone odor during continuous copying |
| Example 11 | Slight toner deposition caused by blotted charge roller | |
| Example 12 | uneven density slightly observed based on uneven charge | |
| Example 13 | Good | |

The problems in Examples 1, 11 and 12 are not in a practically serious level, but the condition of Example 13 is most excellent.

Example 14

Under the same condition as in Example 1, a 50,000-sheet continuous copy was carried out.

Example 15

The copying machine of Example 14 was remodeled, and a zinc stearate supplying member (a mechanism for pressing bar-like zinc stearate for 10 sec after 100-sheet run) was provided between the cleaning member and the charging member. Under this condition, a durability test was performed in the same manner as in Example 14.

Example 16

A durability test was performed in the same manner as Example 14 except adding 0.15 wt % of powdered zinc stearate to the toner supplied to the developing portion in Example 14.

Example 17

A durability test was performed in the same manner as Example 16 except repeating, as the non-image forming operation, only the exposure up to the bright part potential, the toner development thereto by the developing portion, and the recovering operation of the toner on the surface of photoconductor by the cleaning portion for 20 sec every 1000-sheet passing.

After the execution of Examples 14–17, an image output was performed under a high-temperature and high-humidity environment. The surface of photoconductor was observed after the end of the experiment. The result is shown in Table 4.

TABLE 4

| | Image (after 50,000-sheet run) | Others |
|---|---|---|
| Example 14 | Extremely slight image omission | Extremely slight filming |
| Example 15 | Good | Satisfactory image without any filming. |
| Example 16 | Good | Satisfactory image without any filming. Slight image blurring in image output under high temperature and high humidity after run. |
| Example 17 | Good | Satisfactory image without any filming. No image blurring even under high temperature and high humidity. |

Under the condition of Example 14, the surface of photoconductor was slightly filmed when the durability test was performed up to 50,000 sheets, and an image omission according thereto occurred (but it is not in a serious level). In contrast, the filming could be prevented by supplying zinc stearate to the surface of photoconductor as in Examples 15 and 16. Further, the cleaning operation for surface of photoconductor was performed as in Example 17, whereby the image blurring could be perfectly eliminated even under the high temperature and high humidity (30° C., 90% RH).

(Preparation of Photoconductor (j))

A photoconductor (j) was prepared in the same manner as in the photoconductor (f) except changing the protective layer coating solution in the photoconductor (f) to a one having the following composition.

| <Protective Layer Coating Solution> | |
|---|---|
| A-type polycarbonate | 10 parts |
| Charge transporting material of the following structural formula | 8 parts |

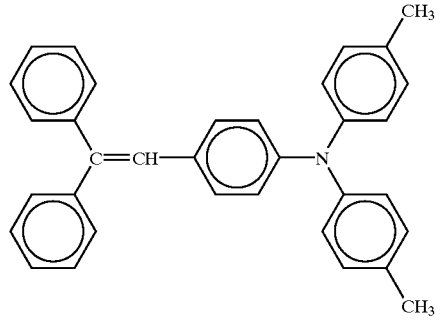

| | |
|---|---|
| Titanium oxide fine particle (Specific resistance: $1.5 \times 10^{10}\Omega \cdot$ cm, average primary particle diameter: 0.5 $\mu$m) | 4 parts |
| Unsaturated polycarboxylic polymer solution (Acid value: 180 mgKOH/g, BYK CHEMIE) | 0.1 parts |
| Tetrahydrofurane | 400 parts |
| Cyclohexanone | 150 parts |

(Preparation of Photoconductor (k))

A photoconductor (k) was prepared in the same manner as in the photoconductor (f) except changing the protective layer coating solution in the photoconductor (f) to a one having the following composition.

| <Protective Layer Coating Solution> | |
|---|---|
| A-Type polycarbonate | 10 parts |
| Charge transporting material of the following structural formula | 8 parts |

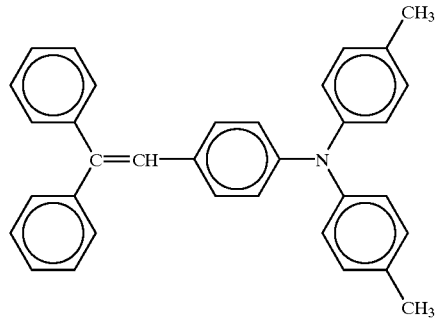

| | |
|---|---|
| Tin oxide-antimony oxide powder (Specific resistance: $1 \times 10^{6}\Omega \cdot$ cm, average primary particle diameter: 0.4 $\mu$m) | 4 parts |
| Unsaturated polycarboxylic polymer solution (Acid value: 180 mgKOH/g, made by BYK CHEMIE) | 0.1 parts |
| Tetrahydrofurane | 400 parts |
| Cyclohexanone | 150 parts |

Examples 18 and 19

The thus-prepared photoconductors (j) and (k) were subjected for actual use evaluation using the product toner A in the same manner as in Example 7.

The result is shown in Table 5 together with that of Example 7.

TABLE 5

| | Toner | Photo-conductor | Z | Angle of Repose (°) | Roundness | Filming to Cleaning Member | Filming to Photo-conductor | Scraped amount of Photoconductor (μm) | Image Density | Uneven image desity | Resolution |
|---|---|---|---|---|---|---|---|---|---|---|---|
| Example 7 | A | f | 0.64 | 22 | 0.96 | ○ | ○ | 1.4 | 1.5 | ○ | ◎ |
| Example 18 | A | j | 0.64 | 22 | 0.96 | ○ | ○ | 1.3 | 1.4 | ○ | ○ |
| Example 19 | A | k | 1.64 | 22 | 0.96 | ○ | ○ | 1.4 | 1.3 | Δ | Δ |

According to the present invention, in a method for forming an electrophotographic image for forming an image on a transfer material at least by the steps for charging, exposing, developing and transferring, and recovering the toner remained untransferred in the step for cleaning, the toner of the step for developing has a total surface area ratio Z of additive, which is calculated by the above-mentioned equation: $Z=(Ht\cdot Wt)/(H\cdot W)$, satisfying $0.5 \leqq Z \leqq 1.5$, the photoconductor used comprises at least a photosensitive layer and a filler-containing protective layer on a conductive support, and the angle of repose of the toner to the protective layer surface of the photoconductor is 30° or less. Such an image forming method and electrophotographic device is used, whereby an image of high quality for image density, uneven image desity, and resolution can be obtained, the filming to photoconductor and cleaning member never occurs, and the scraping of photoconductor can be prevented.

What is claimed is:

1. A method for forming an electrophotographic image comprising;

charging an electrophotographic photoconductor;

exposing the electrophotographic photoconductor charged in charging imagewisly to form an electrostatic latent image;

developing by supplying a toner to the electrostatic latent image to visualize the electrostatic latent image, and forming a developed image;

transferring the developed image formed in developing onto a recording material; and cleaning by recovering the toner remained untransferred on the electrophotographic photoconductor, wherein the toner comprises a toner particle and an additive having a total surface area ratio Z of the additive in the toner, wherein $Z=(Ht\cdot Wt)/(H\cdot W)$, and $0.5 \leqq Z \leqq 1.5$ and the electrophotographic photoconductor comprises at least a photosensitive layer and a protective layer comprising a filler on a conductive support in that order, and an angle of repose of the toner to the protective layer surface of the electrophotographic photoconductor is 30° or less, wherein H is the specific surface area of toner particles ($m^2/g$), W is the weight content of toner particles (%), Ht is the specific surface area of additives ($m^2/g$), and Wt is the content of additives (%).

2. The method for forming an electrophotographic image according to claim 1, wherein the toner is a spherical toner having a roundness of 0.95 or more.

3. The method for forming an electrophotographic image according to claim 1, wherein the filler in the protective layer is an inorganic pigment or metal oxide having a specific resistance of $1\times10^{10}$ Ω·cm or more.

4. The method for forming an electrophotographic image according to claim 1, wherein the filler-containing protective layer comprises a charge transporting material.

5. The method for forming an electrophotographic image according to claim 4, wherein the charge transporting material is a polymer having an electron-donating group.

6. The method for forming an electrophotographic image according to claim 1, wherein the filler-containing protective layer comprises an organic compound having an acid value of 10–400mgKOH/g.

7. The method for forming an electrophotographic image according to claim 1, wherein silicone oil compatible with a material constituting the protective layer of the electrophotographic photoconductor is added to the protective layer in an amount exceeding the limit of the compatibility with the material constituting the protective layer.

8. The method for forming an electrophotographic image according to claim 1, wherein the electrophotographic photoconductor comprises a charge generating material that is a titanyl phthalocyanine having a maximum diffraction peak at least at 27.2° as the diffraction peak (±0.2°) of Bragg angle 2 θ to characteristic X-rays (wavelength 1.542 Å) of CuK α.

9. The method for forming an electrophotographic image according to claim 1, wherein the electrophotographic photoconductor comprises a charge generating material that is an azo pigment of the following formula (A)

(A)

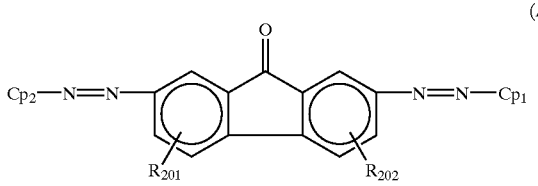

where $Cp_1$ and $Cp_2$, which may be the same or may be different, each represents a coupler residue; $R_{201}$ and $R_{202}$, which may be the same or may be different, each represents a hydrogen atom, a halogen atom, an alkyl group, an alkoxyl group, or a cyano group; and $Cp_1$ and $Cp_2$ are groups expressed by the following formula (B)

(B)

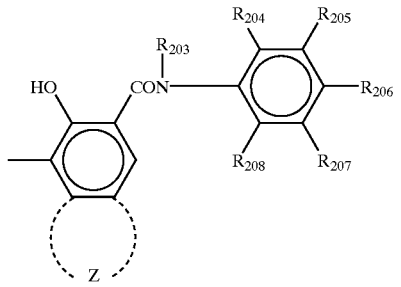

where $R_{203}$ represents a hydrogen atom, an alkyl group, or an aryl group; $R_{204}$, $R_{205}$, $R_{206}$, $R_{207}$, and $R_{208}$ each represents a hydrogen atom, a nitro group, a cyano group, a halogen atom, a trifluoromethyl group, an alkyl group, an alkoxyl group, a dialkylamino group, or a hydroxyl group; and Z represents an atom group necessary for constituting a substituted or non-substituted aromatic carbocyclic residue or a substituted or non-substituted aromatic heterocyclic residue.

10. The method for forming an electrophotographic image according to claim 1, wherein the surface of the conductive support of the electrophotographic photoconductor is anodized.

11. The method for forming an electrophotographic image according to claim 1, further comprising supplying and applying zinc stearate onto the surface of the electrophotographic photoconductor.

12. The method for forming an electrophotographic image according to claim 1, wherein the toner comprises powdered zinc stearate.

13. An electrophotographic device comprising;

an electrophotographic photoconductor;

means for charging the electrophotographic photoconductor;

means for exposing the electrophotographic photoconductor charged by the means for charging imagewisly to form an electrostatic latent image;

means for developing by supplying a toner to the electrostatic latent image to visualize the electrostatic latent image, and forming a developed image;

means for transferring the developed image developed by the means for developing onto a recording material; and means for cleaning by recovering the toner remained untransferred on the electrophotographic photoconductor, wherein the toner comprises a toner particle and an additive having a total surface area ratio Z of the additive in the toner, wherein $Z=(Ht \cdot Wt)/(H \cdot W)$, and $0.5 \leqq Z \leqq 1.5$; and the electrophotographic photoconductor comprises at least a photosensitive layer and a protective layer comprising a filler on a conductive support in that order, and an angle of repose of the toner to the protective layer surface of the electrophotographic photoconductor being 30° or less, wherein H is the specific surface area of toner particles ($m^2/g$), W is the weight content of toner particles (%), Ht is the specific surface area of additives ($m^2/g$), and Wt is the content of additives (%).

14. The electrophotographic device according to claim 13, wherein the toner is a spherical toner having a roundness of 0.95 or more.

15. The electrophotographic device according to claim 13, wherein the filler in the protective layer is an inorganic pigment or metal oxide having a specific resistance of $1 \times 10^{10}$ Ω·cm or more.

16. The electrophotographic device according to claim 13, wherein the filler-containing protective layer comprises a charge transporting material.

17. The electrophotographic device according to claim 16, wherein the charge transporting material is a polymer having an electron-donating group.

18. The electrophotographic device according to claim 13, wherein the filler-containing protective layer comprises an organic compound having an acid value of 10–400 (mgKOH/g).

19. The electrophotographic device according to claim 13, wherein silicone oil compatible with the material constituting the protective layer of the electrophotographic photoconductor is added to the protective layer in an quantity exceeding the limit of the compatibility with the material constituting the protective layer.

20. The electrophotographic device according to claim 13, wherein the electrophotographic photoconductor comprises a charge generating material that is a titanyl phthalocyanine having a maximum diffraction peak at least at 27.2° as the diffraction peak (±0.2°) of Bragg angle 2 θ to characteristic X-rays (wavelength 1.542 Å) of CuK α.

21. The electrophotographic device according to claim 13, wherein the electrophotographic photoconductor comprises a charge generating material that is an azo pigment of the following formula (A):

(A)

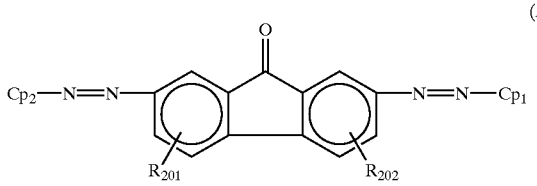

where $Cp_1$ and $Cp_2$, which may be the same or may different, each represents a coupler residue; $R_{201}$ and $R_{202}$, which may be the same or may be different, each represents hydrogen atom, a halogen atom, an alkyl group, an alkoxyl group, and a cyano group; and $Cp_1$ and $Cp_2$ are groups expressed by the following formula (B):

(B)

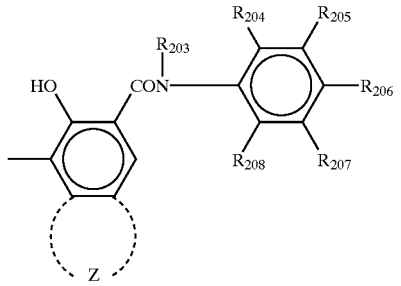

where $R_{203}$ represents hydrogen atom, an alkyl group, or an aryl group; $R_{204}$, $R_{205}$, $R_{206}$, $R_{207}$, and $R_{208}$ each represents hydrogen atom, nitro group, cyano group, a halogen atom, trifluoromethyl group, an alkyl group, an alkoxyl group, a dialkylamino group, or hydroxyl group; and Z represents an atom group necessary for constituting a substituted or non-substituted aromatic carbocyclic residue or a substituted or non-substituted aromatic heterocyclic residue.

22. The electrophotographic device according to claim 13, wherein the surface of the conductive surface of the electrophotographic photoconductor is anodized.

23. The electrophotographic device according to claim 13, wherein the means for charging comprises a charging member is in contact with the electrophotographic photoconductor or is adjacent thereto.

24. The electrophotographic device according to claim 23, wherein the charging member is arranged adjacently to the electrophotographic photoconductor and has a gap therebetween of 200 μm or less.

25. The electrophotographic device according to claim 23, wherein the charging member forms an electric field comprising an AC component superimposed on a DC component, and charges the electrophotographic photoconductor by the electric field.

26. The electrophotographic device according to claim 13, wherein the electrophotographic device further comprises a member for supplying and applying zinc stearate onto the surface of the electrophotographic photoconductor.

27. The electrophotographic device according to claim 13, wherein the toner comprises powdered zinc stearate.

* * * * *